US005170099A

United States Patent [19]

Ueoka et al.

[11] Patent Number: 5,170,099

[45] Date of Patent: Dec. 8, 1992

[54] DISCHARGE LAMP LIGHTING DEVICE

[75] Inventors: Atsushi Ueoka, Moriguchi; Akio Okude, Sakai, both of Japan

[73] Assignee: Matsushita Electric Works, Ltd., Osaka, Japan

[21] Appl. No.: 498,623

[22] Filed: Mar. 26, 1990

[30] Foreign Application Priority Data

Mar. 28, 1989 [JP] Japan ..... 1-75572
Sep. 26, 1989 [JP] Japan ..... 1-249802
Sep. 26, 1989 [JP] Japan ..... 1-249803
Sep. 26, 1989 [JP] Japan ..... 1-249804

[51] Int. Cl.[5] ..... H05B 37/00; H05B 41/29

[52] U.S. Cl. ..... 315/291; 315/175; 315/176; 315/219; 315/224; 315/DIG. 4

[58] Field of Search ..... 315/291, DIG. 7, 224, 315/287, 171, 172, 175, 176, DIG. 4

[56] References Cited

U.S. PATENT DOCUMENTS 4,663,570 5/1987 Lucharco et al. ..... 315/219
4,665,346 5/1987 Tarroux ..... 315/DIG. 7
4,694,224 9/1987 Nakagawa et al. ..... 315/177
4,710,682 12/1987 Zijchtriegel ..... 315/224
4,727,297 2/1988 Wolze ..... 315/DIG. 7
4,876,485 10/1989 Fox ..... 315/224
4,881,012 10/1989 Almering ..... 315/DIG. 7
5,001,386 3/1991 Sullivan et al. ..... 315/219

FOREIGN PATENT DOCUMENTS 643318 7/1982 Japan .
61-296695 12/1986 Japan .

OTHER PUBLICATIONS

F40SP35 General Electric Lamp (No Date).

*Primary Examiner*—Eugene R. LaRoche
*Assistant Examiner*—Son Dinh
*Attorney, Agent, or Firm*—Leydig, Voit & Mayer

[57] ABSTRACT

A discharge lamp lighting device includes a DC power supplying means which supplies as superposed on a high frequency power fed to a low-tension, mercury-arc discharge lamp a DC power of a level capable of maintaining a discharge upon low light flux lighting, the lamp being thereby made stably lighted to an extremely low level of the flux of light.

24 Claims, 26 Drawing Sheets

IC5
IC6
IC7
IC8
Q10
Q11
Q12
Q13
Q14
Q15
Q16
Q17
T10
C26
C27
C28
C29
C30
C31
C32
C33
C34
R35
R36
R37
R38
R39
R40
R41
R42
R43
R44
R45
R46
R47
R48
R49
R50
R51
R52
R53
R54
R55
R56
VR10
VR11
G6
G7
G8
G9
G10
f
g
h
i
j
k
l

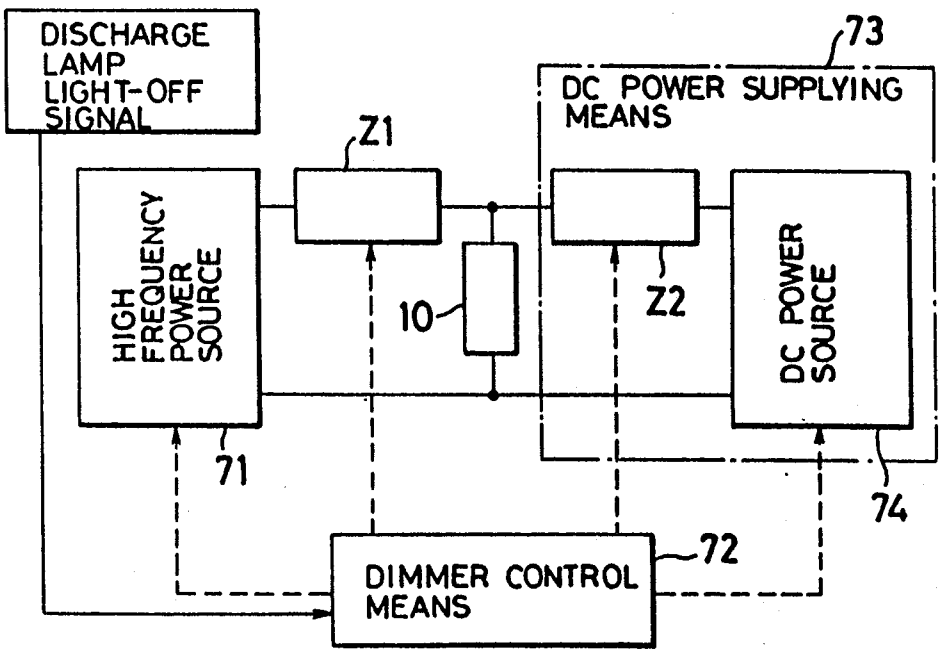
Fig.21
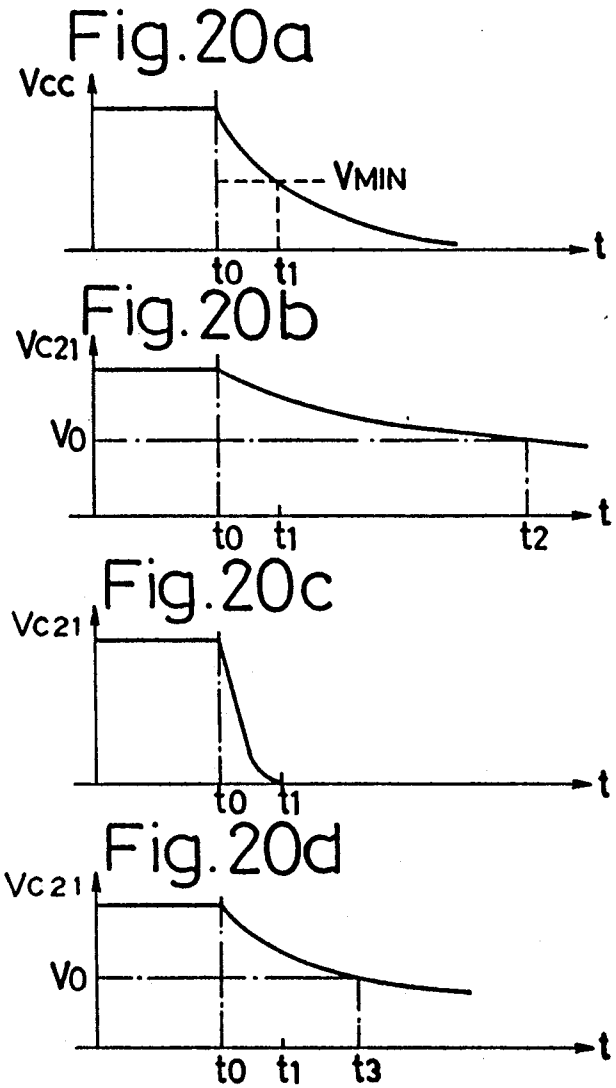
Fig.20a
Fig.20b
Fig.20c
Fig.20d

DISCHARGE LAMP LIGHTING DEVICE

BACKGROUND OF THE INVENTION

This invention relates to a discharge lamp lighting device which is capable of stably lighting a discharge lamp even at an extremely low light flux level, and, if desired, capable of allowing the discharge lamp particularly in a dimmable lighting arrangement to be stably lighted even when the light flux level is lowered from an arc discharge zone to a glow discharge zone.

FIELD OF THE INVENTION

In the discharge lamp lighting device, generally, intended lowering of possible lighting level has been confronted with a limitation, due to that the discharge lamp lighting device has not been provided with any means for stably lighting the lamp upon a low light flux lighting so that, as the lamp current flowing through the discharge lamp is lowered, the discharge lighting cannot be maintained to cause the lamp to eventually reach lighted off state, that is, to a so-called flicker-off state, and the lighting at the low light flux level can hardly be maintained. Provided here that a relative illumination ratio is exceeding 20% with respect to the illumination under a rated current lighting set to be 100%, the flicker-off state can hardly take place. In respect of the discharge lamp lighting device, therefore, it has been generally a major trend that the devices set to be more than 20% in the relative illumination ratio are put in commerce, and the lighting achievable practically in a wider range has been demanded.

DESCRIPTION OF THE RELATED ART

So long as such conditions as an amount of preheating current fed to discharge lamp filament or supplied voltage to the discharge lamp and so on are satisfied, the low light flux lighting can be attained, and there has been provided already a discharge lamp lighting device capable of lighting the discharge lamp even to a 5% level in the relative illumination ratio. It has been required, however, to satisfy the conditions of the preheating current amount, supplied voltage and so on, and there has arisen a problem that required arrangement of the device has to be made complicated to increase manufacturing costs.

There has been suggested an assembly in which such a discharge lamp hardly flickered off as "F40SP35" manufactured by U.S. manufacturers GENERAL ELECTRIC is combined with an ordinary dimmable discharge lamp lighting device such as disclosed in U.S. Pat. No. 4,663,570, but the discharge lamp applicable to this assembly is restricted so that there arises a problem that the freedom of selection of the discharge lamp on the side of users is narrowered and the lamp is not easily available in the market.

In Japanese Patent Application Laid-Open Publication No. 61-296695, for example, there has been disclosed means for preventing the discharge lamp from being flickered off by applying across the discharge lamp cyclically (e.g., every 10 m.sec.) a high voltage pulse (e.g., 1,000V at a pulse width of 300 μsec.). While this will be effective to a prevent the discharge lamp from being flickered off, the high voltage pulse cyclically applied is in an audible range, so that problems will arise in that noise is generated, and circuit elements forming the lighting device are subjected to excessive stress due to the high voltage pulse application. With this discharge lamp lighting device having the measure for preventing the flicker-off, further, it has been empirically found that, in an event where the device is activated to a low light flux level, eventual light emission is bright at lamp tube end but not in the central part of the lamp tube, and this phenomenon happens remarkably in an event of a discharge lamp lighting device of a high frequency lighting type, employing a system in which inner tube surface is coated with a conductor.

In addition, Japanese Patent Application Laid-Open Publication No. 57-118396 or German Patent Publication No. 3,313,916 suggests an arrangement in which a high frequency power is supplied to the discharge lamp and a direct current power is also applied as superposed on the high frequency power. With this discharge lamp lighting device, a direct current bias due to the applied DC power is applied to a discharge lamp current of the supplied high frequency power, whereby such phenomenon known as the striation that a stripe-pattern appears on the discharge lamp tube wall is restrained, and a stable lighting can be realized. In this lighting device, however, the low light flux lighting is not at all intended. That is, this known arrangement still has not reached a level of technical idea of providing a discharge lamp lighting device of the relative illumination ratio exceeding 20% with respect to the illumination under rated current set to be 100% and intended to realize the stable discharge lamp lighting, which device achieving the lighting made to the low light flux level.

Consequently, it has been demanded to realize a stable lighting to a lower light flux level of the relative illumination ratio of 5% or less than that, i.e., than in the case of the foregoing known devices.

SUMMARY OF THE INVENTION

A primary object of the present invention is, therefore, to provide a discharge lamp lighting device which can stably achieve the lighting to an extremely low light flux level of less than 20% in the relative illumination ratio or, in particular, 5% or less than that, with respect to the illumination under rated conditions set to be 100%, and which can stably achieve a dimming of the discharge lamp over a wide range from 100% illumination under the rated conditions to such extremely low light flux level as less than 5% in the relative illumination ratio.

According to the present invention, the above object can be realized by a discharge lamp lighting device in which a high frequency power is supplied from a high frequency power source through a control means to a low-intension, mercury-arc discharge lamp, for enabling such discharge lamp to be lighted, characterized in that the device comprises a DC power supplying means which applies to the low-intension, mercury-arc discharge lamp a DC power of a level capable of maintaining a lighting discharge upon low light flux lighting, as superposed on the high frequency power to the lamp.

Other objects and advantages of the present invention shall be made clear in following description of the invention detailed with reference to embodiments of the invention as shown in accompanying drawings.

BRIEF DESCRIPTION OF THE DRAWINGS

FIG. 4, 4*a* and 4*b* are a detailed circuit diagram of the device shown in FIG. 3;

FIGS. 20(*a*) to 20(*d*) are operational waveform diagrams for the device of FIG. 19;

FIG. 21 is a block diagram of another working aspect of the device of FIG. 19;

While the present invention shall now be described with reference to the respective embodiments shown in the accompanying drawings, it should be appreciated that the intention is not to limit the invention only to these embodiments but rather to include all alterations, modifications and equivalent arrangements possible within the scope of appended claims.

DETAILED DESCRIPTION OF THE PREFERRED EMBODIMENTS

Figure 1:
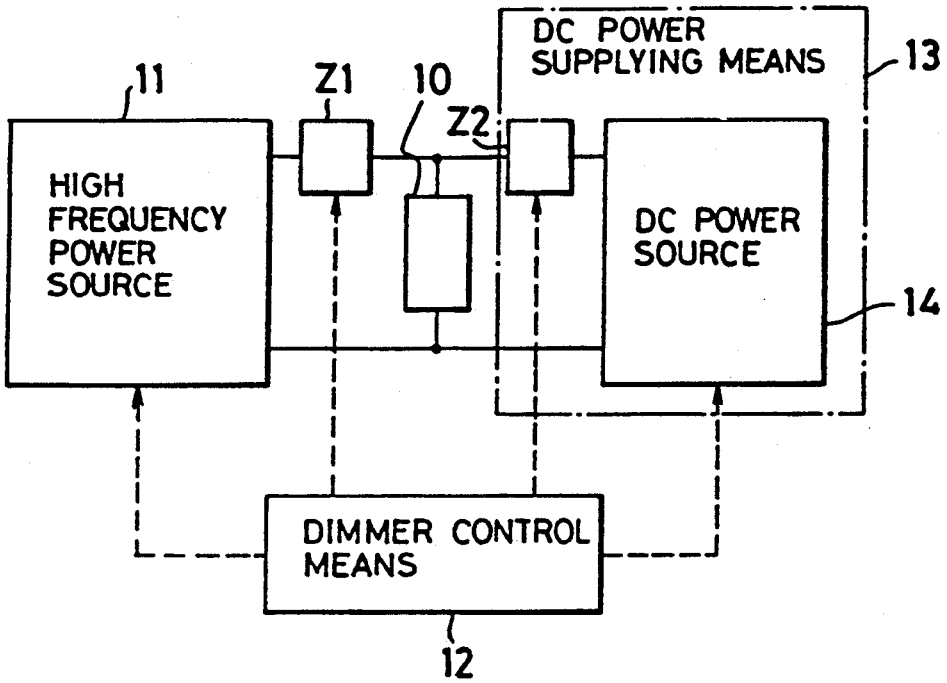
FIG. 1 is a block diagram showing an embodiment of the discharge lamp lighting device according to the present invention.

Referring to FIG. 1 showing a basic embodiment of the dimmable discharge lamp lighting device according to the present invention, the device generally comprises a low-intension mercury-arc discharge lamp 10, a high frequency power source 11 supplying a high frequency power to the lamp 1, a dimmer control means 12 carrying out a dimming of the lamp 10 from an arc discharge zone to a glow discharge zone, and a direct current power supplying means 13 which supplies to the lamp 10 a direct current power at a level capable of maintaining discharge upon a low light flux dimming, as superposed on the high frequency power from the source 11 to the lamp 10, while the DC power supplying means 13 includes a direct current source 14.

In the present instance, the arrangement is so made that a control signal from the dimmer control means 12 for controlling the dimming of the discharge lamp 10 will be provided to the high frequency power source 11, impedance elements Z1 and Z2 and DC power source 14 respectively concurrently, but the arrangement may not be always for such concurrent provision of the control signal to all of such components. For example, the control signal may be provided only to the high frequency power source 11, the high frequency output obtained from the high frequency power source 11 is varied in the frequency to have the supplied power to the lamp 10 controlled, and the dimming can thereby carried out. Further, the control signal may be input from the dimmer control means 12 to the DC power source 14 so as to have a DC component from the DC power supplying means 13 varied, and the DC component made optimum in accordance with dimming degree can be applied to the lamp 10. For the impedance elements Z1 and Z2 disposed respectively between the high frequency power source 11 and the lamp 10 and the DC power source 14 and the lamp 10, one Z1 of them may comprise a saturable inductance, so that the value of this inductance may be controlled by the control signal input thereto for realing the dimming. By forming the other impedance element Z2 with a resistance element and a switching element so that the switching element may be made on and off by the control signal provided to such impedance element Z2, and the DC power to the discharge lamp 10 may be controlled in the amount of being superposed. In this case, the impedance element Z2 may comprise only the switching element, and an impedance of the discharge lamp 10 may be utilized as that of a resistance element.

Figure 2:
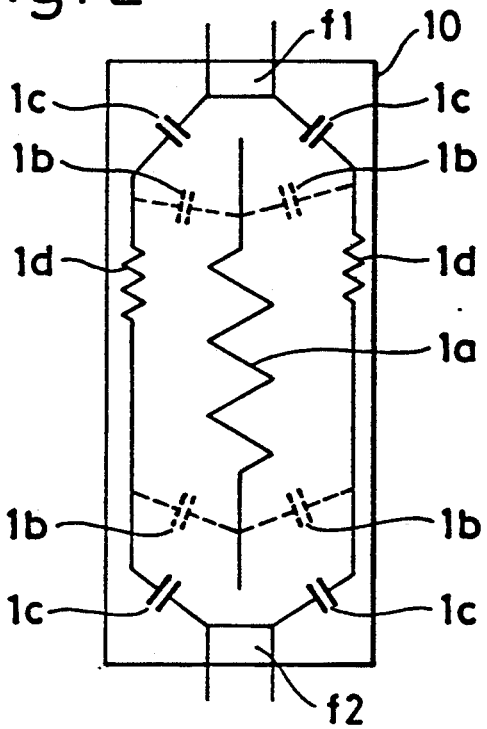
FIG. 2 is an explanatory view for a discharge lamp in the device of FIG. 1.

When an alternating current high frequency power is supplied to the discharge lamp 10, the current flowing through the lamp 10 may be regarded to be divided into a main current and a dark current. Referring here to an equivalent circuit as in FIG. 2 of the discharge lamp 10, it is assumed for simplicity that a discharge path comprises a negative resistance 1*a*, a capacitive impedance 1*b* is present between the negative resistance 1*a* and a lamp tube wall, and a further capacitive impedance 1*c* is present between lamp filaments f1 and f2 and the lamp tube wall. In the event where the lamp 10 is lighted with a rated current applied thereto, the main current flows sufficiently through the filaments f1 and f2 to the discharge path to maintain the discharge path represented by the negative resistance 1*a*. On the other hand, as the dimming is carried out, the main current reduces to have the ratio of the dark current relatively increased, the dark current being not contributive to the light emission, and, as the dimming is carried out further over a certain level, the current flowing through the negative resistance 1*a* forming the discharge path is caused to flow only to a tube wall impedance 1*d* through the capacitive impedance 1*b* between the negative resistance 1*a* and the tube wall, and the discharge path cannot be retained any more. As a result, all of the supplied currents are caused to become dark currents, and the flicker-off takes place in the discharge lamp 10.

Figure 36:
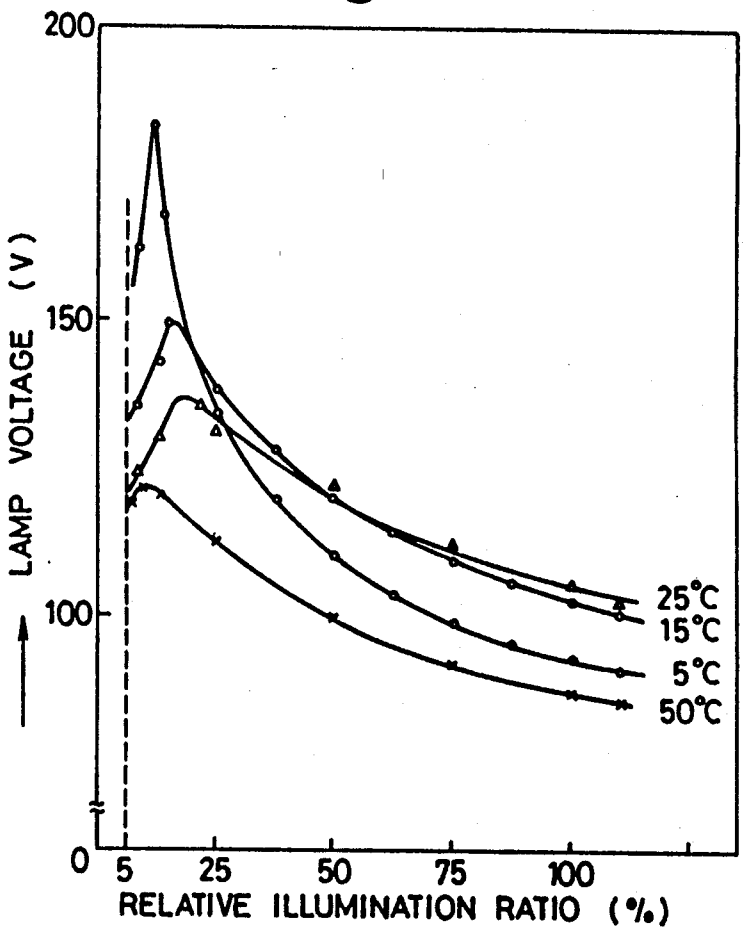
FIG. 36 is a diagram showing the relationship between the relative illumination ratio and the required voltage in a device not having the DC power supplying means according to the present invention.

The relationship between the power voltage and the relative illumination ratio with the illumination under the rated lighting made 100% has been measured by supplying a high frequency power through a high frequency power source of 40 KHz and an insulating transformer for insulating the source to a straight 40W tube of a low intension mercury-arc discharge lamp of the inner surface conductor coated type, for example, (which has been manufactured by the present assignee firm as "FLR40W-F/MX") while applying thereto a preheating current Ip=0.4A, and varying the high frequency power to the discharge lamp for its dimming operation, results of which measurement have been as shown in FIG. 36 diagrammatically. As will be clear from this diagram, the lamp voltage rises as the relative illumination ratio falls so that the rise will be abrupt when the relative illumination ratio is around 10–20%, and the thus raised lamp voltage abruptly falls toward about 5% of the relative illumination ratio so that the discharge lamp lighting has flickered off when the relative illumination ratio is about 5%. While this tendency has been remarkable as the lamp temperature is made lower, the discharge lamp lighting has become difficult to maintain when the relative illumination ratio is less than 20%, irrespective of the lamp temperature, and the lighting has flickered off at about 5% of the relative illumination ratio in every case of different lamp temperatures. Further, similar measurement has been carried out with respect to other types of the low intension mercury-arc discharge lamps, and substantially the same results have been attained.

From the foregoing viewpoint, it is required to have the discharge path always kept established in order carry out the dimming to an extremely low level of the relative illumination ratio and, for this purpose, it is required to supply the current so as not to become the dark current. It should be appreciated here that the applied current is required to be made a direct current in order that the current will not flow to such capacitive impedance components as the impedance components 1*b* between the negative resistance 1*a* and the lamp tube wall and the impedance components 1*c* between the filaments f1, f2 and the lamp tube wall.

Figure 35:
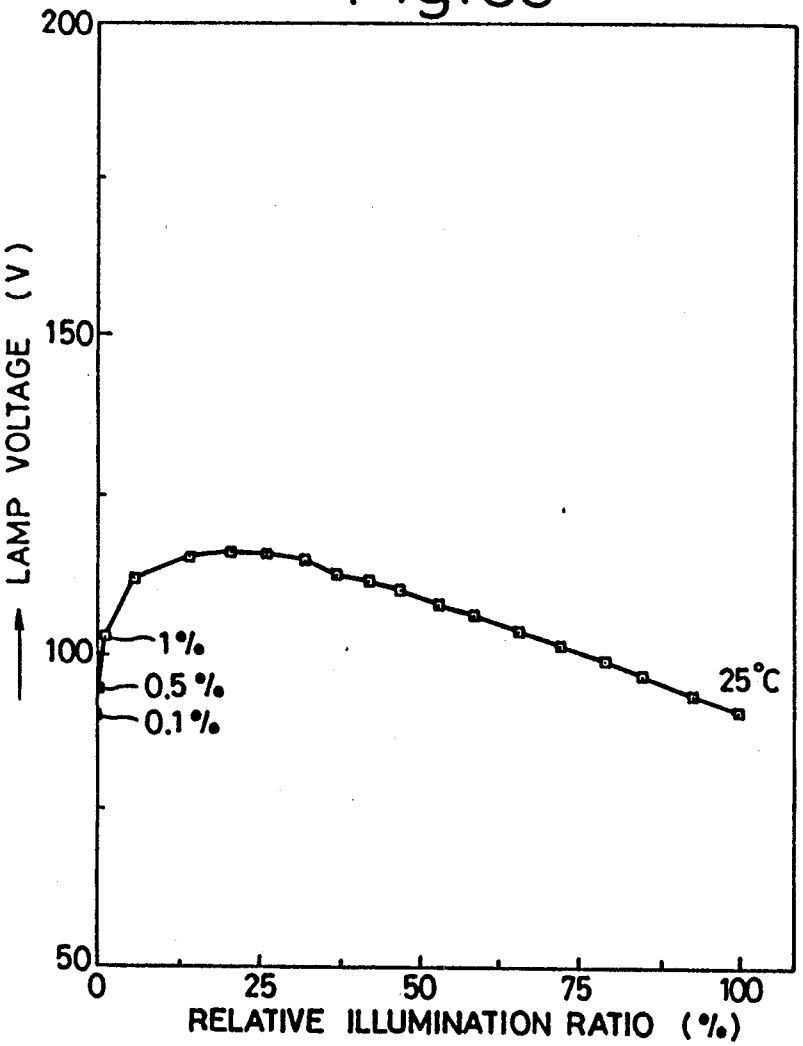
FIG. 35 is a diagram showing the relationship between the relative illumination ratio and the required voltage in the dimmable discharge lamp lighting device according to the present invention.

According to the present invention, the arrangement is so made that the DC power at a level capable of maintaining the discharge upon the low light flux is applied to the discharge lamp 10 as superposed on the high frequency power by means of the DC power supplying means 13 as shown in FIG. 1, no current is therefore made to flow through the capacitive impedance components 1*b* and 1*c* so as to restrain or remarkably reduce the dark current, and the discharge path can be well established. Consequently, the relationship between the lamp voltage and the relative illumination or, in other words, the light flux, approximating that shown in FIG. 36 has been attained by carrying out the lighting by supplying a power through the high frequency power source and the insulating transformer to the straight 40W tube of the low-intension, mercury-arc discharge lamp also of the inner surface conductor coated type, manufactured by the present assignee firm as FLR40S/MX-36, and applying the DC power as superposed on the power by means of the DC current applying means 13 while providing the preheating current Ip=0.4A and varying the high frequency power. Results of this measurement have been as shown in FIG. 35, in which it has been empirically made known that the discharge lamp lighting device according to the present invention allows the lamp lighting realized even at an extremely low light flux level, without any flickering-off, and the lighting can be attained even when the relative illumination or the light flux is lowered to be closer to 0.1%.

Figure 3:
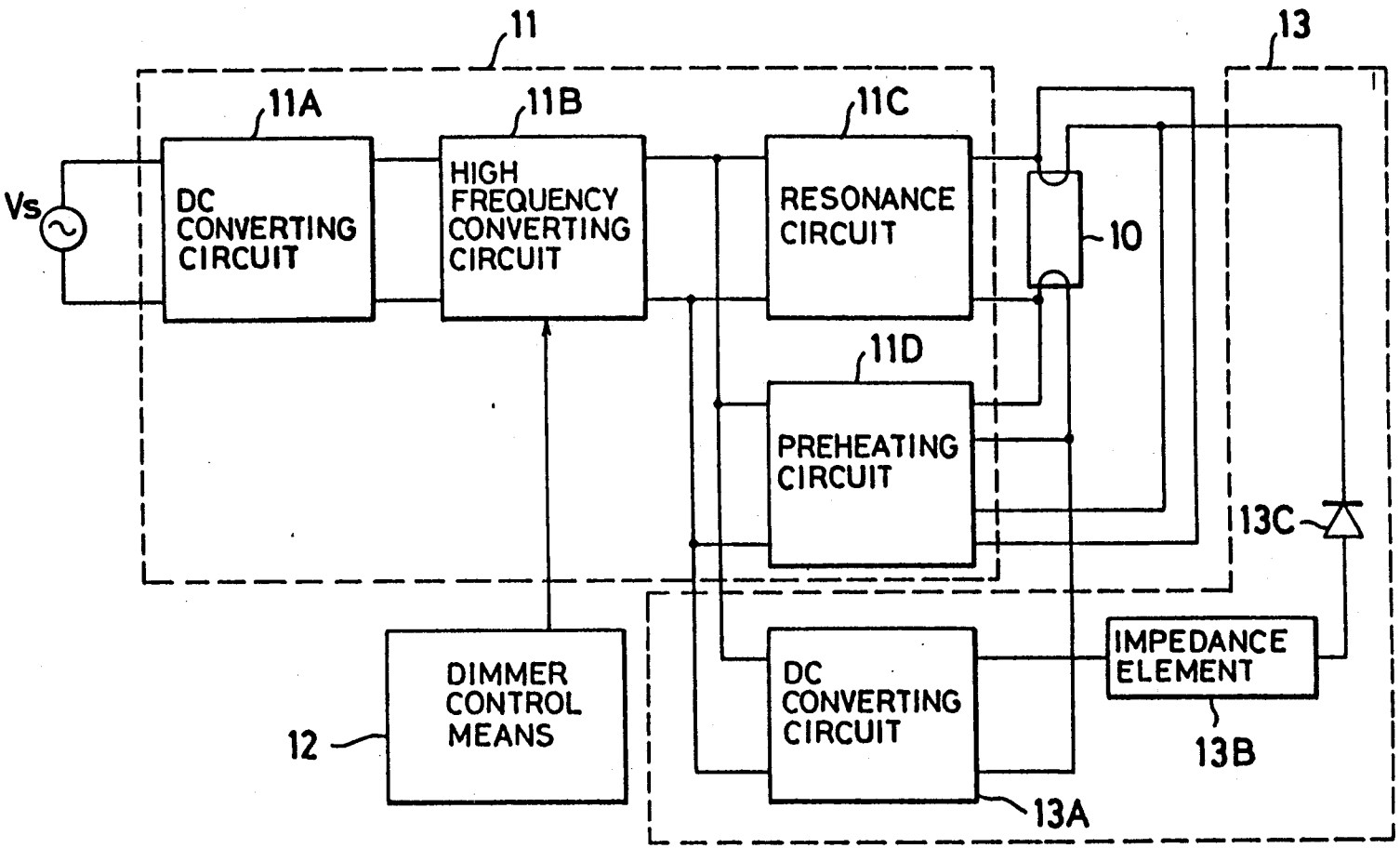
FIG. 3 is a block diagram showing another working aspect of the device in FIG. 1.

A more concrete arrangement of the present invention shall now be detailed. Referring to FIG. 3, an AC voltage of a commercial AC source Vs is converted into a DC voltage by a DC converting circuit 11A of the high frequency power source 11 and is then converted into a high frequency voltage by a high frequency converting circuit 11B, and this high frequency voltage is applied across the discharge lamp 10 through a resonance circuit 11*c*. At the same time, a preheating current is provided from a preheating circuit 11D to the filaments f1 and f2 of the discharge lamp 10. The high frequency voltage obtained at the high frequency converting circuit 11B is converted into a DC voltage by a DC converting circuit 13A in the DC power supplying means 13, and this DC voltage is applied across the discharge lamp 10 through an impedance element 13B and diode 13C, so that a DC power at the discharge maintaining level upon the lower light flux lighting can be applied to the discharge lamp as superposed on the high frequency power.

Figure 4A:
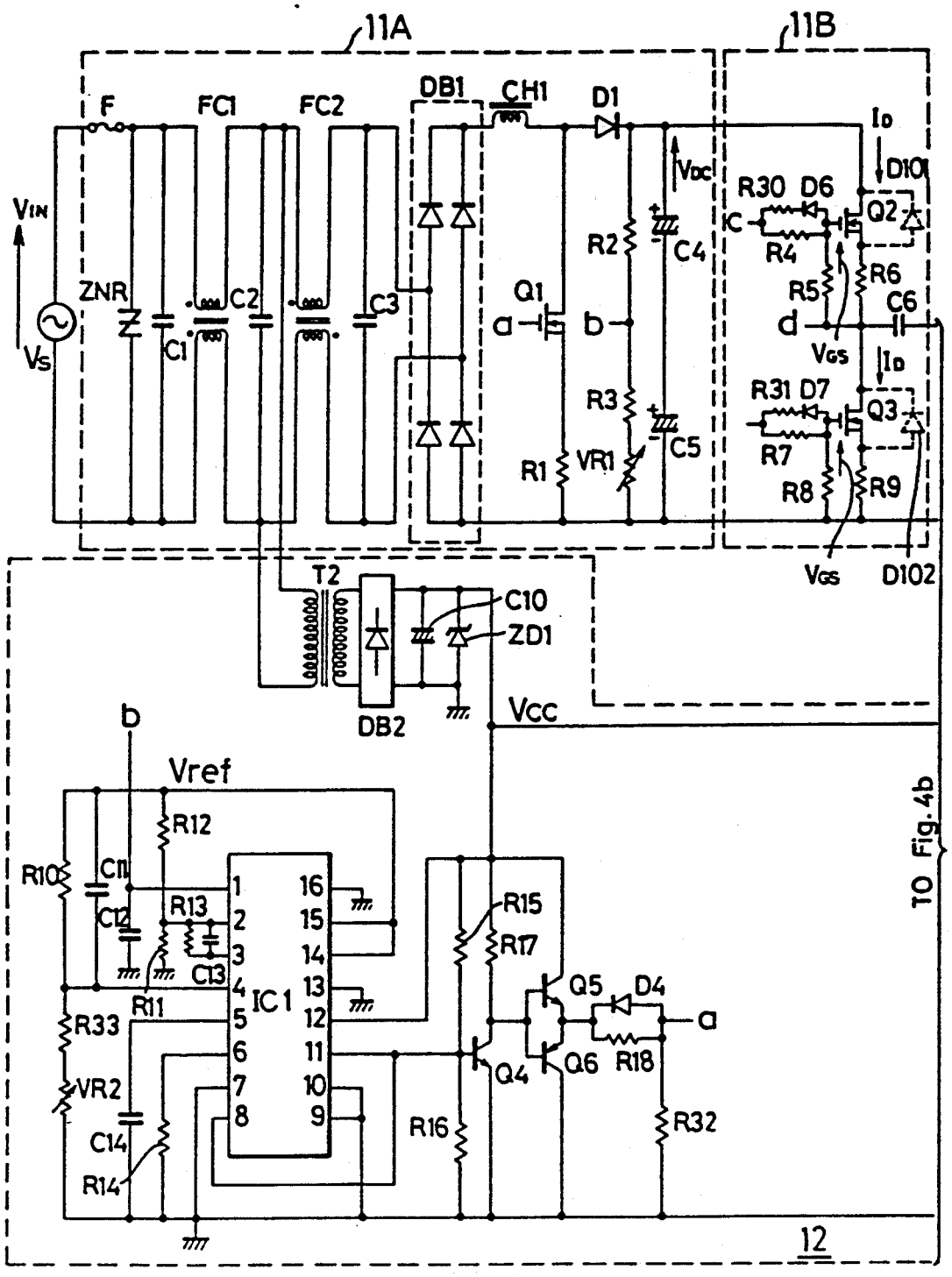
Figure 4:
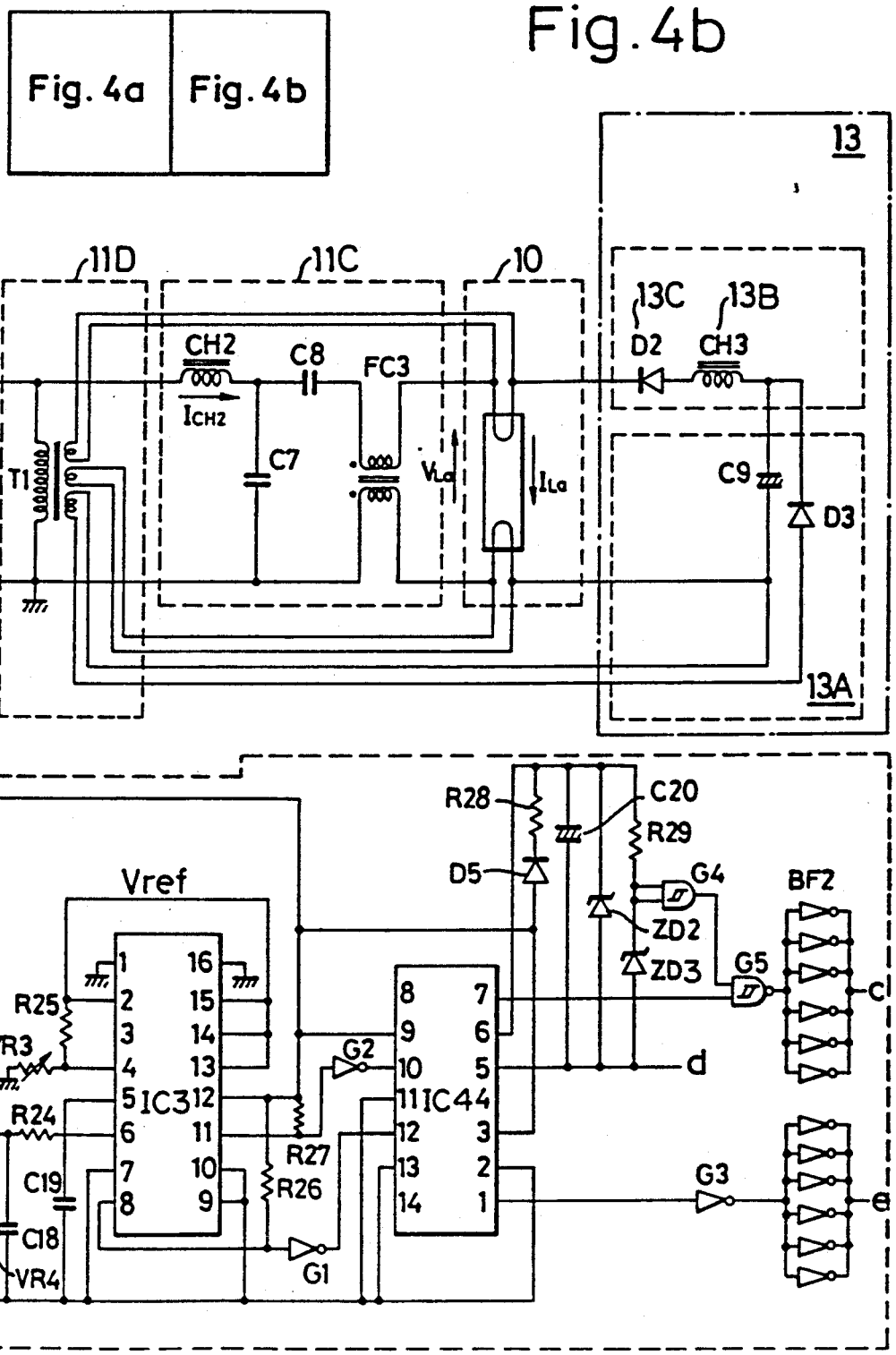

In FIG. 4, there is shown a more detailed circuit arrangement of that in FIG. 3 is shown, in which instance the commercial AC source Vs is connected, more concretely, through a fuse F and filter coils FC1 and FC2 in the DC converting circuit 11A to AC input terminals of a diode bridge DB1. To input side of the filter coil FC1, a surge absorber ZNR and a noise preventive capacitor C1 are connected in parallel and, to input and output sides of the filter coil FC2, noise preventive capacitors C2 and C3 are connected respectively in parallel. To a positive output terminal of the diode bridge DB1, an inductor CHI is connected at its one end while the other end of this inductor CHI is connected to a drain of MOS transistor Q1 employed as a chopper. This MOS transistor Q1 is connected at its source through a low resistor R1 to the other negative output terminal of the diode bridge DB1, and at its drain to one end of a series circuit of capacitors C4 and C5 through anode and cathode of a reverse-flow preventing diode D1 while the other end of this series circuit is connected to the other negative output terminal. Across the series circuit of the capacitors C4 and C5, a series circuit of resistors R2 and R3 and a variable resistance VR1 is connected in parallel, while a junction point "b" between the both resistors R2 and R3 forms a detecting terminal for allowing a DC voltage $V_{DC}$ obtained at the series circuit of capacitors 4 and 5 to be detected.

In the thus arranged DC converting circuit 11A, the MOS transistor Q1 is to be switched on and off at a high speed by means of an oscillation output "a" of an oscillation circuit IC1 latter described. When the MOS transistor Q1 is switched on, first, the DC output end of the diode bridge DB1 is caused to be short-circuited by the inductor CH1, whereby a current flowing through the inductor CH1 is increased at a gradient proportional to the magnitude of the DC output voltage of the diode bridge DB1, and an energy is to be accumulated in the inductor CH1. As the MOS transistor Q1 is switched off, this energy in the inductor CH1 is discharged, a boosting chopper circuit is thereby formed to charge the capacitors C4 and C5 through the diode D1 so that, even when a momentary voltage of the commercial AC source Vs is low, a charging current will be caused to flow to the capacitors C4 and C5 and the voltage $V_{DC}$ of the capacitors C4 and C5 can be sufficiently smoothed.

By switching on and off the MOS transistor Q1 at the high speed in this way, it is made possible to always flow an input current through the inductor CH1 from the commercial AC source Vs, and the inductor CH1 will have a current waveform of a sinusoidal envelope. When such current waveform is subjected to a filtering through the filter coils FC1 and FC2 and the noise preventive capacitors C1 to C3 so that the current will be continuous, the input current from the commercial AC power source Vs will be a sine wave which is in-phase with an input voltage $V_{IN}$ and the input power factor will be substantially 1. Further, the input current will be smaller in the distortion factor, and the higher harmonic component is made less. Here, the filter coils FC1 and FC2 as well as the noise preventive capacitors C1–C3 are so set in the circuit constant as to show a low impedance with respect to the commercial AC frequency and a high impedance with respect to a switching frequency of the MOS transistor Q1.

In the high frequency converting circuit 11B, a MOS transistor Q2 is connected at its drain to a positive output terminal of the DC converting circuit 11A, at its source through a low resistor R6 to a drain of another MOS transistor Q3 which is connected at its source through a low resistor R9 to a negative output terminal of the DC converting circuit 11A. Here, the low resistors R1, R6 and R9 connected in series to the source side of the respective MOS transistors Q1, Q2 and Q3 are provided for preventing any overcurrent. The MOS transistor Q3 is connected at its drain through a capacitor C6 for cutting DC component to a later-stage load circuit comprising a preheating circuit 11D, resonance circuit 11C and the discharge lamp 10. In this high frequency converting circuit 11B, first, the MOS transistor Q2 on higher potential side is switched on and off by a first drive signal applied across high potential side drive terminals "c" and "d", upon which the MOS transistor Q2 is connected at its gate through a resistor R5 to the drive terminal "d". Between the drive terminal "c" and the gate of the MOS transistor Q2, a resistor R4 is connected, and a series circuit of a resistor R30 and diode D6 is further connected in parallel to the resistor R4. The higher potential side drive terminal "c" is controlled by a later described inverter control means so that "H" level state and "L" level state will alternate in the sense of high frequency with the higher potential side terminal "d" made as the reference. When this drive terminal "c" is at the "H" level with respect to the high potential side terminal "d" as the reference, a divided voltage of this "H" level voltage by the resistors R4 and R5 is applied to the gate of the MOS transistor Q2, whereby a voltage $V_{GS}$ across the gate and source of the MOS transistor Q2 is raised so that the MOS transistor Q2 will be switched on.

When the drive terminal "c" is at the "L" level with respect to the high potential side terminal "d" as the reference, next, a charge accumulated at a capacity across the gate and source of the MOS transistor Q2 is discharged through the diode D6 and resistor R30, the voltage $V_{GS}$ across the gate and source of the transistor Q2 falls, and this transistor is thereby caused to be switched off. Then, the MOS transistor Q3 on the lower potential side is switched on by a second drive signal applied across the lower potential side drive terminal "c" and ground level. Here, a further lower potential side drive terminal "e" is controlled to alternate in the sense of the high frequency between "H" level state and "L" level state with the ground level made as the reference, by means of a later described inverter control means. Driving circuit arrangement and its operation for the MOS transistor Q3 are substantially the same as those of the MOS transistor Q2, resistors R7, R8 and R31 correspond respectively to the resistors R4, R5 and R30, and diode 7 corresponds to the diode D6.

In the present instance, the first and second drive signals are not made to be simultaneously at the "H" level, and a first period in which the first drive signal is at the "H" level but the second drive signal is at the "L" level, a second period in which the first and second drive signals are both at the "L" level, a third period in which the first drive signal is at the "L" level but the second drive signal is at the "H" level and a fourth period in which the first and second drive signals are both at the "L" level are repeated sequentially and constantly in this order. More specifically, in the first period, the MOS transistor Q2 is made ON while the MOS transistor Q3 is made OFF so that a current will flow through a path form the positive output terminal of the DC converting circuit 11A through the MOS transistor Q2, low resistor R6, DC component cutting capacitor C6 and load circuit to the negative output terminal of the circuit 11A. In the second period, the MOS transistors Q2 and Q3 are both made OFF concurrently, so that an oscillation current will flow through a parasitically incorporated reverse parallel diode D102 across the drain and source of the MOS transistor Q3. In the third period, the MOS transistor Q2 is OFF while the MOS transistor Q3 is ON so that, with the DC component cutting capacitor C6 made as a power source, a current will flow through a path from this capacitor C6 through the MOS transistor Q3, low resistor R9 and load circuit back to the capacitor C6. In the fourth period, the MOS transistors Q2 and Q3 are concurrently made OFF, so that the oscillation current of the load circuit will flow through also a parasitically incorporated reverse parallel diode D101 across the drain and source of the MOS transistor Q2, whereby a high frequency, alternating current is caused to flow through the load circuit. The MOS transistors Q2 and Q3 may be so set in the switching frequency as to be slightly higher than the specific oscillation frequency of the load circuit.

Next, the preheating circuit 11D comprises a preheating transformer T1 having a primary winding connected to the high frequency output of the high frequency converting circuit 11B, and first and second secondary windings connected respectively to the first and second filaments f1 and f2 of the discharge lamp 10, whereby a high frequency voltage to which a high frequency output of the high frequency converting circuit 11B is dropped is applied to the filaments f1 and f2 of the discharge lamp 10 to preheat them with the high frequency. A high frequency voltage obtained at a third secondary winding of the preheat transformer T1 is supplied to a DC converting circuit 13A so as to be a source of the DC power supplying means 13.

The resonance circuit 11C comprises a series circuit of an inductor CH2 and capacitor C7 connected to the high frequency output of the high frequency converting circuit 11B, and the discharge lamp 10 is connected across the capacitor C7 through a capacitor C8 and a filter FC3 so that the lamp 10 will be started and lighted by rendering the high frequency output of the high frequency converting circuit 11B to be in resonance. The filter FC3 is effective to carry out a noise preventing function.

The DC converting circuit 13A in the DC power supplying means 13 comprises a diode D9 for rectifying the high frequency voltage obtained at the third secondary winding of the preheating transformer T1 and a smoothing capacitor C9 for smoothing the rectified voltage, so that a power source will be formed to provide a power into which the high frequency voltage from the high frequency converting circuit 11B is rectified and smoothed. The DC voltage obtained at the smoothing capacitor C9 is applied through an inductor CH3 and a diode D2 to the discharge lamp 10. The inductor CH3 acting as an impedance element 13B can be an impedance by its copper loss component with respect to the direct current but, with respect to the high frequency from the resonance circuit 11C, its inductive reactance jwL with L representing the inductance value of the inductor CH3 will be the impedance, so as to achieve a function of preventing any runaround with respect to the high frequency. The diode D2 which corresponds to the diode 13c in FIG. 3 prevents the smoothing capacitor C9 from being charged by a voltage across the discharge lamp 10. The DC voltage from the DC power supplying means 13 is blocked by the capacitor C8 from flowing to the preheating transformer T1 in the preheating circuit 11D but is allowed to flow only to the main current path to the discharge lamp 10.

As has been disclosed, the high frequency voltage from the high frequency converting circuit 11B is applied across the discharge lamp 10, and the DC voltage from the DC power supplying means 13 is superposed thereon. Since the voltage attained at the capacitors C4 and C5 in the DC converting circuit 11A is the substantially completely smoothed DC voltage as in the above, the envelope of the high frequency voltage from the high frequency converting circuit 11B will be also flat, so that the light output of the discharge lamp 10 produces substantially no flickering.

Referring next to the control means 12 more specifically, the means 12 comprises a chopper controlling circuit section for controlling the MOS transistor Q1 employed as the chopper for a voltage boosting in the DC converting circuit 11A, an inverter control circuit section for controlling the MOS transistors Q2 and Q3 in the high frequency converting circuit 11B, and a control power source circuit section for supplying a control power source voltage $V_{cc}$ to these circuit sections. First, the control power source circuit section comprises a voltage dropping transformer T2 having a primary winding connected to both ends of the capacitor C2 in the DC converting circuit 11A and a secondary winding connected to an AC input terminals of a diode bridge DB2 to DC output terminals of which a capacitor C10 and a Zener diode ZD1 are connected in parallel to each other, while the Zener diode ZD1 is connected on its anode side to the ground level and is receiving on its cathode side the operational source voltage $V_{cc}$ for the both circuit sections.

The chopper controlling circuit section includes an oscillating circuit IC1 which comprises such an IC for controlling a switching regulator as "μPC494C" by a Japanese manufacturer NEC. This controlling IC receives the control power source voltage $V_{cc}$ across a source terminal (12th pin) and a grounding terminal (7th pin), and incorporates therein an oscillator which oscillates at a frequency in accordance with a time constant determined by a capacitor C14 connected between a capacitor terminal (5th pin) and the grounding terminal and a resistor R14 connected between a resistor terminal (6th pin) and the grounding terminal. Its first oscillating output is obtained by an alternation between short-circuit state and open state across a first open collector terminal (8th pin) and a first open emitter terminal (9th pin), and a second oscillating output is obtained by an alternation between a short-circuit state and an open state across a second open collector terminal (11th pin) and a second open emitter terminal (10th pin). When an output control terminal (13th pin) is made at the ground level, the IC carries out a single end operation for single element so that the first oscillating output corresponds to the second oscillating output whereas, when the output control terminal is set at a reference voltage $V_{ref}$ obtained at a reference voltage output terminal (14th pin), a push-pull operation for two elements is carried out so that the first and second oscillating outputs take mutually opposite state through a predetermined dead-off time which can be set by inputting to a dead-off time control terminal (4th pin) a divided voltage of the reference voltage $V_{ref}$ level by means of resistors R10 and R33 and a variable resistor VR2. Further, non-inverting terminals (1st and 16th pins) and inverting terminals (2nd and 15th pins) are input terminals for an error amplifying circuit for pulse width control. In this case, the first non-inverting terminal (1st pin) is receiving a divided voltage of an output voltage $V_{DC}$ of the DC converting circuit 11A by means of resistors R2 and R3 and a variable resistor VR1, and this terminal is connected through a capacitor C12 to the ground level. The first inverting terminal (2nd pin) is receiving a divided voltage of the reference voltage $V_{ref}$ by means of resistors R11 and R12. On the other hand, the second non-inverting input terminal (16th pin) is pulled down to the ground level and the second inverting input terminal (15th pin) is pulled down to the level of the control source voltage $V_{cc}$, and these terminals are not in use here. A feed-back terminal (3rd pin) is a feed-back input terminal, which is connected through a resistor R13 and capacitor C13 to the first inverting input terminal (2nd pin).

In the foregoing arrangement, an output control terminal (13th pin) is pulled down to the ground level so that the first and second oscillating outputs are coinciding with each other, their oscillating frequency is determined by the time constant of the resistor R14 and capacitor C14, and the pulse width is to be controlled so as to cancel any voltage variation occurring in the output voltage $V_{DC}$ of the DC converting circuit 11A. The oscillating output of the above oscillating circuit IC1 is supplied through a driving circuit including transistors Q4–Q6 to the drive terminal "a" of the MOS transistor Q1. In this driving circuit including the transistors Q4–Q6, the first and second open emitter terminals (9th and 10th pins) are connected to the ground level, and the first and second open collector terminals (8th and 11th pins) are connected to the base of the transistor Q4. When the first and second open collector terminals are in non-conducting state with the first and second open emitter terminals, a bias voltage obtained by dividing the control source voltage $V_{cc}$ by resistors R15 and R16 is applied to the base of the transistor Q4. When the first and second open collector terminals are in conduction with the first and second open emitter terminals, on the other hand, the base of the transistor Q4 is pulled down to the ground level and the transistor Q4 is turned off. The emitter of the transistor Q4 is connected to the ground level, while its collector is connected through a resistor R17 to the level of the control power source voltage $V_{cc}$ and to the base of each of the transistors Q5 and Q6. When the transistor Q4 is turned on, therefore, the transistors Q5 and Q6 are lowered in the base potential but, when the transistor Q4 is turned off, they are raised in the base potential. The collector of the transistor Q5 is connected to the level of the control source voltage $V_{cc}$, while the collector of the transistor Q6 is connected to the ground level. The transistors Q5 and Q6 are connected at their emitter through a parallel circuit of a resistor R18 and a diode D4 to the drive terminal "a" of the MOS transistor Q1, and this terminal is connected to the ground level. The transistor Q5 is of NPN type while the transistor Q6 is of PNP type and, when their base potential is elevated, the transistor Q5 is turned on while the transistor Q6 is turned off, upon which a current is made to flow from the control power source voltage $V_{cc}$ through the transistor Q5 and resistors R18 and R32, and a voltage is generated across the resistor R32. This generated voltage is applied to the drive terminal "a" of the MOS transistor Q1, the potential across the gate and source of the transistor Q1 is thereby elevated, and the transistor Q1 is turned on. As the transistor Q4 turns on to lower the base potential of the transistors Q5 and Q6, the transistor Q5 is turned off, upon which the accumulated charge across the gate and source of the MOS transistor Q1 is discharged through the diode D4, across the emitter and base of the transistor Q6 and across the collector and emitter of the transistor Q4 to cause a base current to flow through the transistor Q6, whereby the transistor Q6 is made conductive across the emitter and collector, and the accumulated charge across the gate and source of the MOS transistor Q1 is rapidly discharged, whereby a driving circuit of the MOS transistor Q1 is formed.

The inverter control circuit section includes an oscillating circuit IC3 for which a controlling IC (μPC494C by NEC) for the switching regulator may be employed, and respective terminals of this IC are substantially of the same function as in the foregoing oscillating circuit IC1. In the present oscillating circuit IC3, the non-inverting input terminals (1st and 16th pins) and inverting input terminals (2nd and 15th pins) for the pulse width controlling are not used, and the former terminals are pulled down to the ground level while the latter terminals are pulled up to the level of the reference voltage $V_{ref}$ obtained at a reference voltage output terminal (14th pin). The reference voltage $V_{ref}$ is applied to an output control terminal (13th pin) so that the oscillating circuit IC3 will perform a push-pull operation, and a divided voltage of the reference voltage $V_{ref}$ by a resistor R25 and variable resistor VR3 is applied to a dead-off time control terminal (4th pin) to have a dead-off time to be set. A capacitor terminal (5th pin) is connected through a capacitor C19 to the ground level, and a resistor terminal (6th pin) is also connected to the ground level but through a resistor R24 and variable resistor VR4. Oscillating frequency of the oscillating circuit IC3 is determined by a time constant of the capacitor C19, resistor R24 and variable resistor VR4. To this variable resistor VR4, a capacitor C18 is connected in parallel thereto, so that the oscillating frequency of the oscillating circuit IC3 will be varied gradually even when the resistance value of the variable resistor VR4 is rapidly varied. Between a source terminal (12th pin) and a ground terminal (7th pin), the control power source voltage $V_{cc}$ is applied. First and second open emitter terminals (9th and 10th pins) are connected to the ground level, and first and second open collector terminals (8th and 11th pins) are pulled up respectively through resistors R26 and R27 to the level of the control power source voltage $V_{cc}$ and are connected to input ends of first and second inverting buffers G1 and G2. When the first open collector terminal (8th pin) is conducted with the first open emitter terminal (9th pin), the first open collector terminal (8th pin) is made at "L" level, and the first inverting buffer G1 provides an "H" level output. As the first open collector terminal (8th pin) comes to non-conducting state with the first open emitter terminal (9th pin), the first open collector terminal (8th pin) is pulled up through the resistor R26 to the level of the control power source voltage $V_{cc}$ to be at "H" level, and the output of the first inverting buffer G1 will be at "L" level. Similarly, when the second open collector terminal (11th pin) is in conducting state with the second open emitter terminal (10th pin), the output of the second inverting buffer G2 will be at "L" level but, when they are in non-conducting state, the output of the second inverting buffer G2 will be at "L" level.

Further, the inverter control circuit section includes a driver circuit IC4 for which a high speed, high withstand voltage bridge driver IC ("IR2110" by a U.S. manufacturer IR) may be employed. In the present instance, input terminals (12th and 10th pins) are connected to output ends of the inverting buffer G1 and G2, respectively, and drive signals are provided to output terminals (1st and 7th pins) with the same waveform and a dielectric strength of 500V. One of these outputs obtained at the first output terminal (1st pin) is supplied to the drive terminal "e" of the MOS transistor Q3 on the lower potential side through an inverting buffer G3 and inverting buffer group BF1. To the terminal "d" of the MOS transistor Q2, a high potential side terminal (5th pin) of a driver circuit IC4 is connected. The other output obtained at the second output terminal (7th pin) is supplied through an inverting Schmitt gate G5 and inverting buffer group BF2 to the drive terminal "c" of the MOS transistor Q2 on the higher potential side. A circuit made by a diode D5, resistor R28 and capacitor C20 is forming a so-called boost lap circuit, which supplies a source voltage for the drive signal on the high potential drive signal obtained at the second output terminal (7th pin). This source voltage obtained through the capacitor C20 is restricted by a Zener diode ZD2 to a constant voltage. When the voltage at the capacitor C20 is lower than a predetermined level, an output of a Schmitt buffer G4 will be at "L" level and the signal is blocked for passing through the inverting Schmitt gate G5. As the voltage at the capacitor C20 is elevated and a voltage above a threshold level is input to the Schmitt buffer G4 by means of a constant voltage circuit comprising a resistor R29 and Zener diode ZD3, the output of the Schmitt buffer G4 is made to be at "L" level, and the signal is allowed to pass through the inverting Schmitt gate G4.

In the discharge lamp lighting device according to the embodiment of the present invention and including the foregoing dimmer control means 12, the operating frequency of the high frequency converting circuit 11B can be varied by varying the value of the variable resistor VR4, and a so-called frequency dimming is made possible. In this case, the operating frequency of the high frequency converting circuit 11B made to vary in a range higher than the natural oscillation frequency of the load circuit will cause a lagging current to flow through the load circuit, so that the switching operation of the MOS transistors Q2 and Q3 can be stably carried out. More concretely, the operating frequency of the high frequency converting circuit 11B is gradually separated from the natural oscillation frequency of the load circuit by gradually reducing the value of the variable resistor VR4 so as to gradually weaken the resonating action of the resonance circuit 11*c*, and the dimming of the discharge lamp 10 can be achieved. Since the value of the variable resistor VR4 can be sequentially varied, the dimming of the discharge lamp is made sequentially achievable.

Figure 5A:
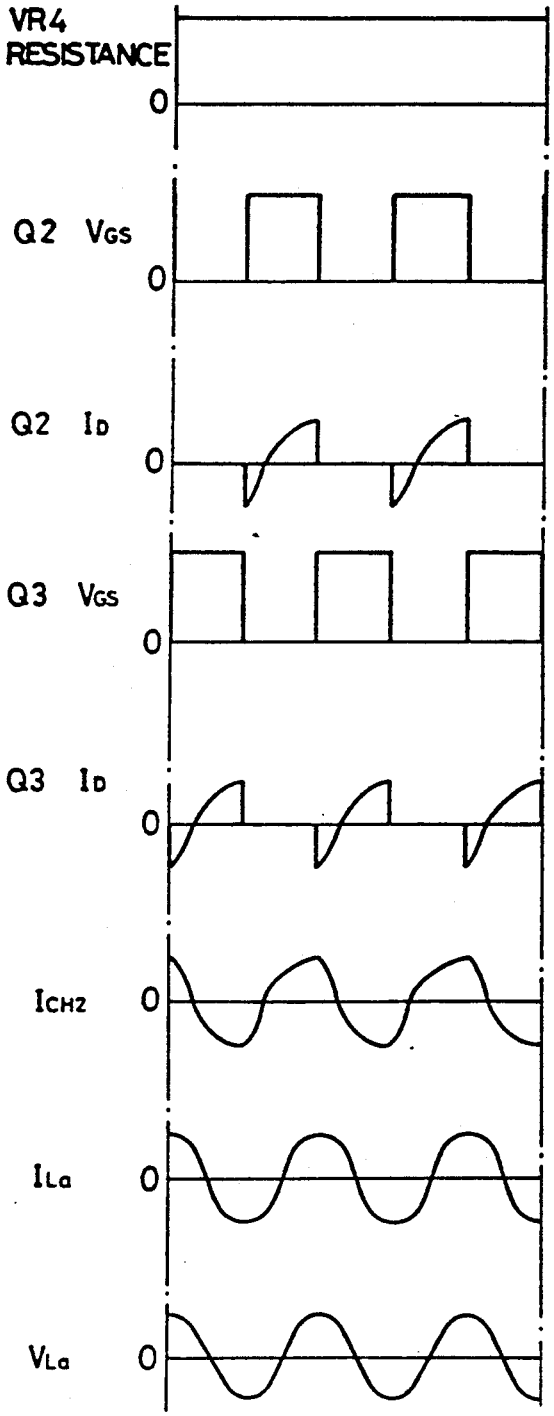
FIGS. 5(*a*) and 5(*b*) are waveform diagrams at respective parts in the circuit of FIG. 4.
Figure 5B:
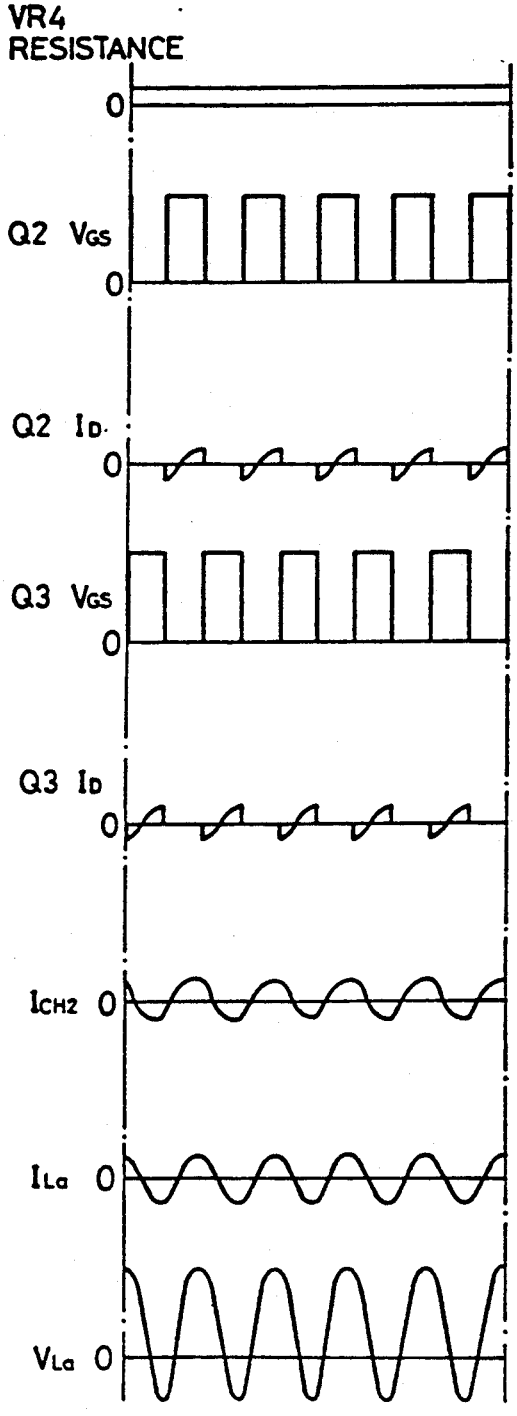
Figure 6:
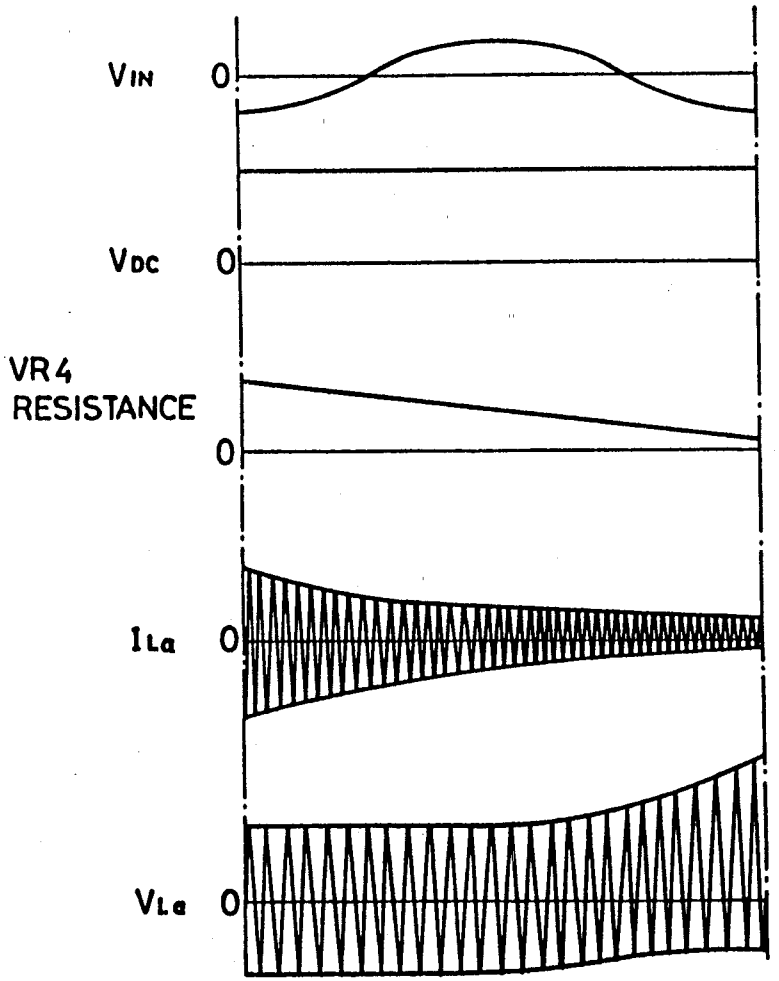
FIG. 6 is a diagram showing waveforms at respective parts in the circuit of FIG. 4.

The high-frequency operation of the foregoing circuit is shown in FIGS. 5(*a*) and 5(*b*), the former being of a state in which the discharge lamp 10 is in its full lighting, while the latter being of a state in which the discharge lamp 10 is in the dimming lighting. As will be clear from the drawings, the oscillating frequency is raised by reducing the value of the variable resistor VR4, a resonance current $I_{CH2}$ flowing through the inductor CH2 is made smaller and the lamp current $I_{La}$ is reduced. At the same time, the ratio of DC bias component occupying in the lamp voltage $V_{La}$ is increased. As will be clear from FIG. 6 showing a low frequency operation of the foregoing circuit, the value of the variable resistor VR4 made smaller renders the ratio of the DC bias component in the lamp voltage $V_{La}$ to be increased. Voltage waveforms and current waveforms are all made to be positive in the direction shown by respective arrows in FIG. 4.

Figure 7A:
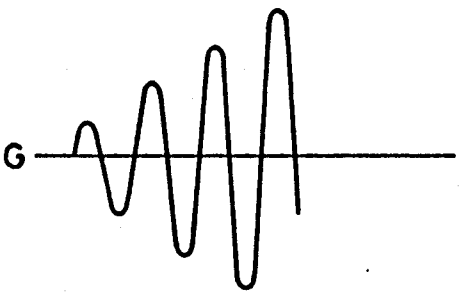
FIGS. 7(*a*) and 7(*b*) are waveform diagrams of the power applied to the discharge lamp respectively at different states.
Figure 7B:
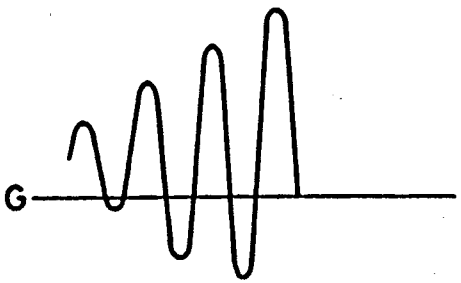

With respect to the discharge lamp lighting device of the foregoing embodiment, tests have been carried out as applied to such various types of the discharge lamps as an outer surface conductor coating, an inner surface conductor coating, and a PS (a sort of the inner surface conductor coating with kripton sealed in discharge lamp tube for energy saving purpose), and results approximating to those shown in FIG. 35 have been obtained, according to which it has been found that a stably controlled dimming can be attained by the device in the respective types of the lamp even to such a low light flux level as less than 0.5% in the relative illumination ratio. In addition to that the intended object of the invention can be attained by the foregoing circuit arrangement, the DC voltage value applied to the discharge lamp 10 can be optionally set so that the voltage value can be set to be relatively so low as to be about 40V, for example, and the voltage value across the lamp and socket before mounting of the lamp can be restrained to be low, so as to be advantageous in the safety. Upon starting the discharge lamp 10, further, the DC voltage from the DE power supplying means 13 is superposed on such high frequency voltage as in FIG. 7(*a*) by means of a resonance circuit 23 so that the peak of the voltage applied to the discharge lamp 10 will become so high as shown in FIG. 7(*b*), and it is also possible to improve the startability.

While in the foregoing embodiment the frequency dimming has been employed as a dimming means, such other dimming system as a duty control or the like may also be employed. For the high frequency converting circuit 11B, a so-called half bridge inverter system has been disclosed to be employed, but a single element inverter system or a full bridge inverter system may also be utilized. While an inductor has been employed as the impedance element 13B, such other impedance element as a resistor or the like may be employed, and the preheating transformer T1 used in the preheating circuit 13D may also be replaced by a capacitor preheating by means of a resonant capacitor.

Figure 8:
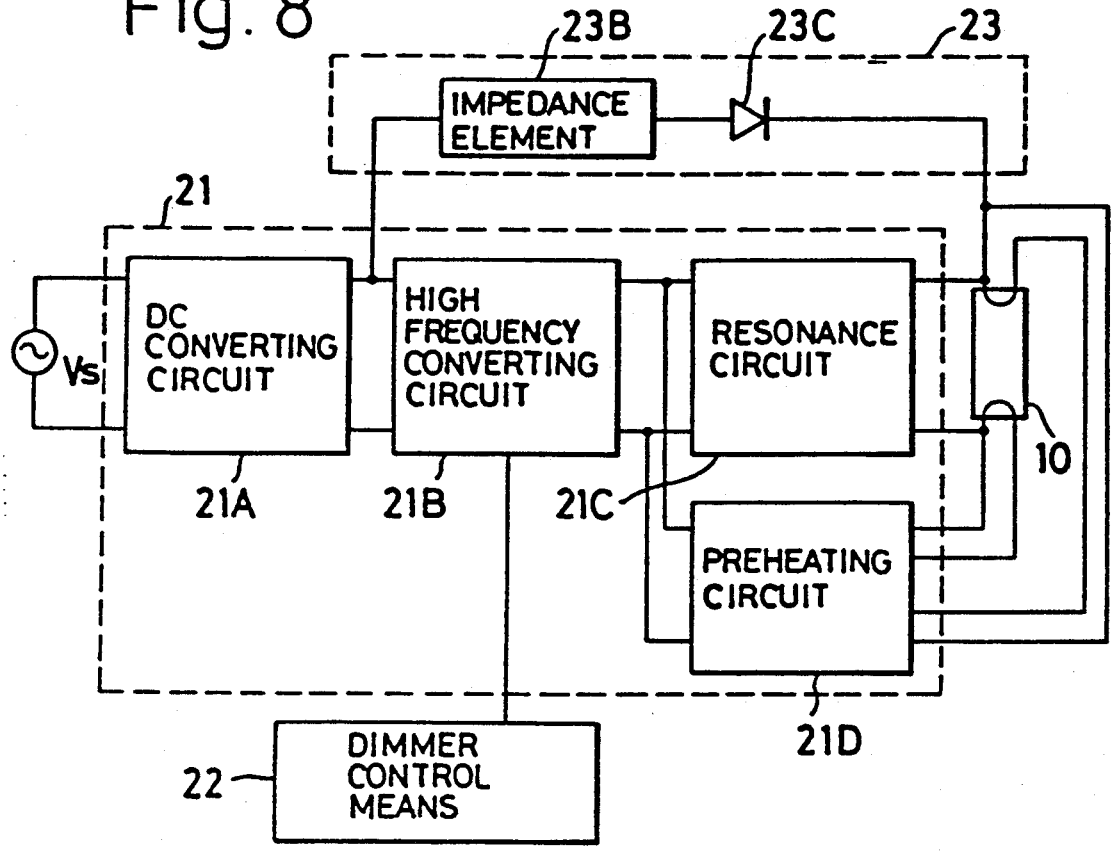
FIG. 8 is a block diagram in another working aspect of the device of FIG. 1.

Referring now to FIG. 8 showing another concrete working aspect of the discharge lamp lighting device of FIG. 1, a single DC converting circuit 21A is disposed for common use in contrast to the two DC converting circuits 11A and 13A in the foregoing aspect of FIG. 3, that is, the arrangement is so made here that the DC voltage from the DC converting circuit 21A is applied to the discharge lamp 10 through a DC power supplying means 23 including an impedance element 23B and diode 23C as superposed on a high frequency power. In the present instance, by the way, it is possible to omit the diode 23C inserted in series between the discharge lamp 10 and the impedance element 23B in an event where the DC voltage is higher than the lamp voltage or the impedance of the impedance element 23B is made so large as to be 100K, for example, so that the run-around of the high frequency power with respect to the DC power may be deemed less. In the present aspect, the same constituents as in FIG. 3 are denoted by the same reference numerals but added by 10 as those in FIG. 3, and other arrangements and functions are substantially the same as those in the case of FIG. 3.

Figure 9:
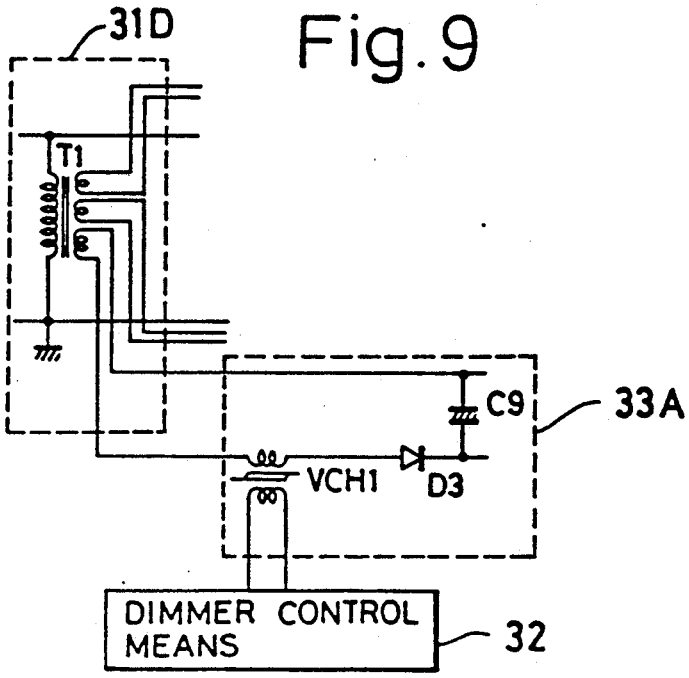
FIG. 9 is a block diagram showing another embodiment of the discharge lamp lighting device according to the present invention.

According to another remarkable feature of the present invention, there is provided a discharge lamp lighting device in which the power source of the DC power supplying means can be of a variable value. Referring to FIG. 9, there is shown a main part of a discharge lamp lighting device for working the particular feature, in which a high frequency voltage obtainable by the preheating transformer T1 in the preheating circuit 31D is supplied through a saturable reactor VCH1 to a rectifying diode D3. The saturable reactor VCH1 is controlled by the dimmer control means 12 so set an optional inductance, whereby the supplied power from the high frequency source to a smoothing capacitor C9 is controlled, and the source voltage of the DC power supplying means 33 is to be set at an optionally predetermined level. In this case, the source voltage level can be set in correspondence to the optical output of the discharge lamp 10, a dimming level setting signal or the like. In the arrangement of FIG. 9, the same elements as those in FIG. 3 are denoted by the same reference numerals added by 20 also as those in FIG. 3, and all other arrangements and functions are also substantially the same as those in FIG. 3.

According to still another feature of the present invention, there is suggested a discharge lamp lighting device in which the DC power is supplied to the discharge lamp 10 as superposed on the high frequency power only at a dimming level where the flicker-off of the discharge lamp 10 is likely to occur, so that a risk of cataphoresis or a deterioration of lamp life which occurring when the DC power is always supplied as superposed to the discharge lamp 10 can be avoided. Referring more in detail to the discharge lamp lighting device for working this feature with reference to FIG. 10, this device is provided with a lamp current detecting circuit 43D as a means for detecting the relative illumination ratio. In the present instance, a current transformer is inserted in series in the lamp current path, and the lamp current detecting circuit 43D is connected to this transformer for detecting the lamp current. When the thus detected lamp current is large, a switching control circuit 43E connected to the lamp current detecting circuit 43D is driven and a switching circuit 43F inserted in series between the discharge lamp 10 and the series circuit of impedance element 43B and diode 43C is thereby turned off, whereby the superposed supply of the DC power to the discharge lamp 10 is ceased in the event when the lamp current fed to the discharge lamp 10 is above a predetermined level, that is, upon the dimming at the level not causing the flicker-off of the discharge lamp 10. With this arrangement of the present embodiment, further, it is made possible to reliably stop any application of the DC voltage to the lamp socket in no load state (with the discharge lamp not mounted) for sufficiently improving the device in the safety.

As the means for detecting the relative illumination ratio, other than the foregoing lamp current detecting circuit, it is also possible to detect, for example, resonance current $I_{CH2}$ flowing through the inductor CH2 in FIG. 4. Further, the driving signal to the switching control circuit 43 may be made obtainable by means of a dimming level setting signal as shown in FIG. 10.

Figure 10:
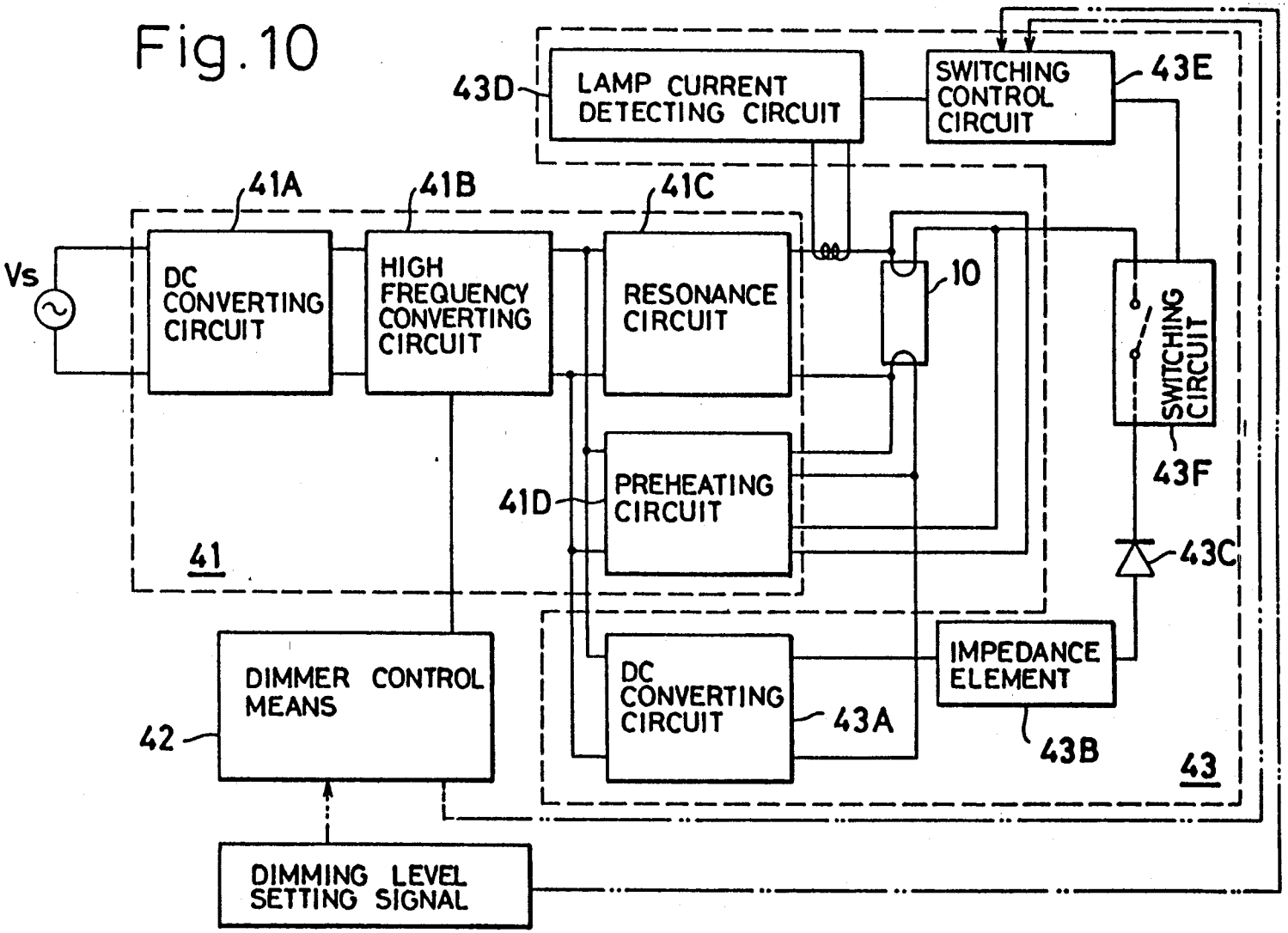
FIG. 10 is a block diagram showing still another embodiment of the dimmable discharge lamp lighting device according to the present invention.

In the embodiment of FIG. 10, the same constituents as those in FIG. 3 are denoted by the same reference numerals but added by 30 as those in FIG. 3, and other arrangements and functions are substantially the same as those in FIG. 3.

Figure 11:
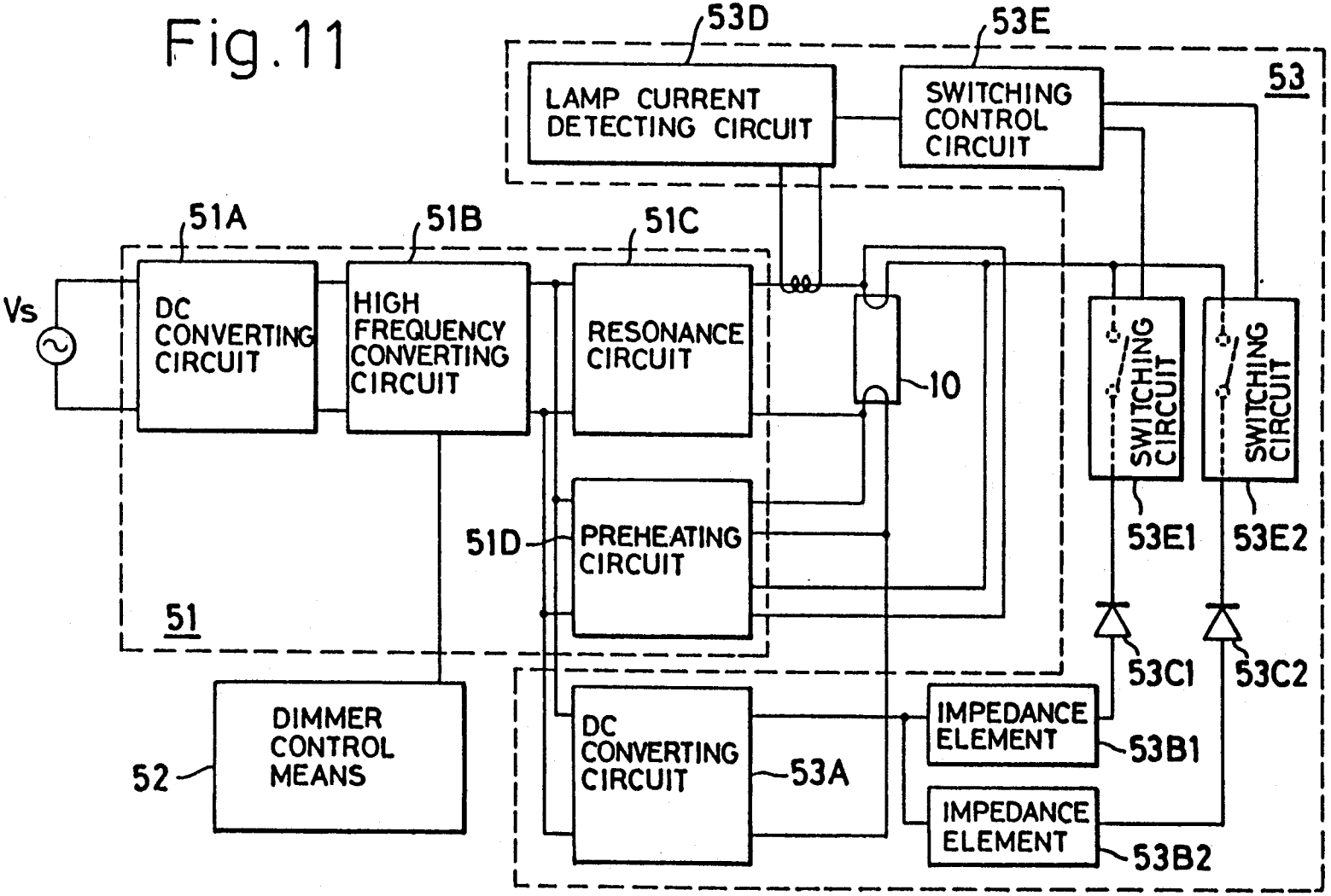
FIG. 11 is a block diagram showing still another working aspect of the device of FIG. 10.

In FIG. 11, another working aspect of the device of FIG. 10 is shown, in which the impedance element 43B, diode 43C and switching circuit 43F in FIG. 10 are provided as divided respectively into first and second impedance elements 53B1 and 53B2, first and second diodes 53C1 and 53C2 and first and second switching circuits $53E_1$ and $53_2$. In the present instance, it may also be possible to provide the switching circuit for the DC current superposed to be more than three to be 53F1, 53F2, . . . 53Fn connected in parallel, so that the dimming level at which the respective switching circuits are turned on or off may be separately set so as to allow the DC power of an optimum value in accordance with the dimming level to be superposed on the lamp current and the dimming to be properly realized. While in the aspect of FIG. 11 the arrangement is so made that the lamp current is detected by the lamp current detecting circuit 53D, that the switching circuits $53E_1$ and $53_2$ are controlled through the switching control circuit 53E, and that the proper DC current responsive to the dimming level is superposed on the lamp current, it may be also possible to modify the arrangement for providing a control signal from the dimmer control means 52 to the switching circuits 53F1 and 53F2 or, as has been described with reference to the embodiment of FIG. 10, for controlling the switching circuits 53F1 and 53F2 by the optimum dimming level setting signal.

In the working aspects of FIGS. 10 and 11, on the other hand, it is preferable to provide to the on or off operation of the respective switching circuits $53_2$ and 53F2 a hysteresis characteristic with respect to the dimming level so that, even when the discharge lamp 10 is likely to cause a flicker to occur upon repetition of the switching operation due to a difference in the optical output of the discharge lamp 10 at the time of turning on or off of the respective switching circuits 53F1 and 53F2, the flicker can be avoided by the hysteresis characteristic.

In the working aspect of FIG. 11, the same constituents as in FIG. 3 are denoted by the same reference numerals but added by 40 as those in FIG. 3, and other arrangements and functions are substantially the same as those in FIG. 3.

According to still another feature of the present invention, there is suggested a discharge lamp lighting device in which any stress imposed to the switching element included in the switching circuit can be effectively reduced. While in the foregoing device of, for example, FIGS. 10 and 11 there has been a problem that the switching element in the switching circuit is required to be durable to such high voltage as the starting voltage, this problem can be overcome by the device working the present feature. Referring in detail to this device with reference to FIG. 12, as will be clear when compared with the embodiment of FIG. 1, a parallel circuit of a DC power controlling switching means SW1 for controlling the DC power to the discharge lamp 10 and an overcurrent preventing switching means SW2 made conductive upon starting of the discharge lamp 10 is connected between the second impedance element Z2 and the DC power source 64, while these switching means may be replaced by a common switching element provided that it achieves the both functions.

For the overcurrent preventive switching means SW2, such passive overvoltage preventing element as Zener diode, avaranche diode, surge absorber or the like may be employed. This passive overvoltage preventing element may be of a breakdown voltage which is below the lamp starting voltage and above the lamp lighting voltage, and no separate control circuit for this element is required to be provided.

Figure 12:
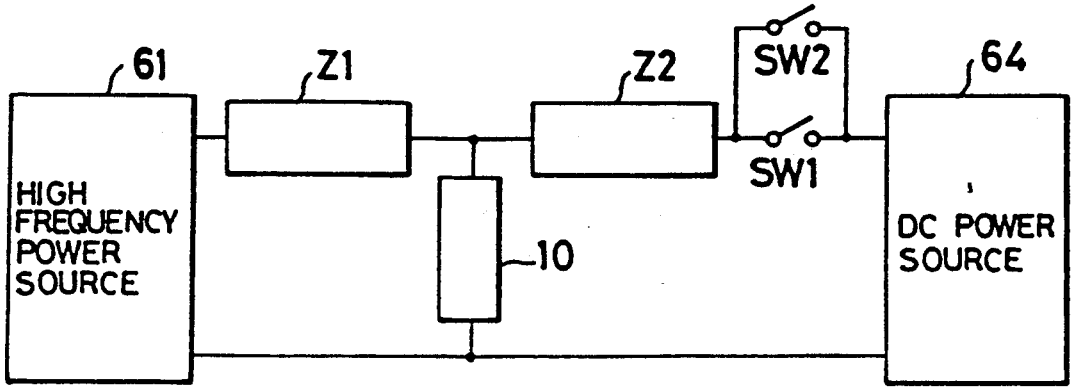
FIG. 12 is a block diagram a further embodiment of the dimmable discharge lamp lighting device according to the present invention.

In the device of FIG. 12, the same constituents as those in FIG. 1 are denoted by the same reference numerals but added by 50 as those in FIG. 1, and other arrangements and functions are substantially the same as those in FIG. 1.

Figure 13:
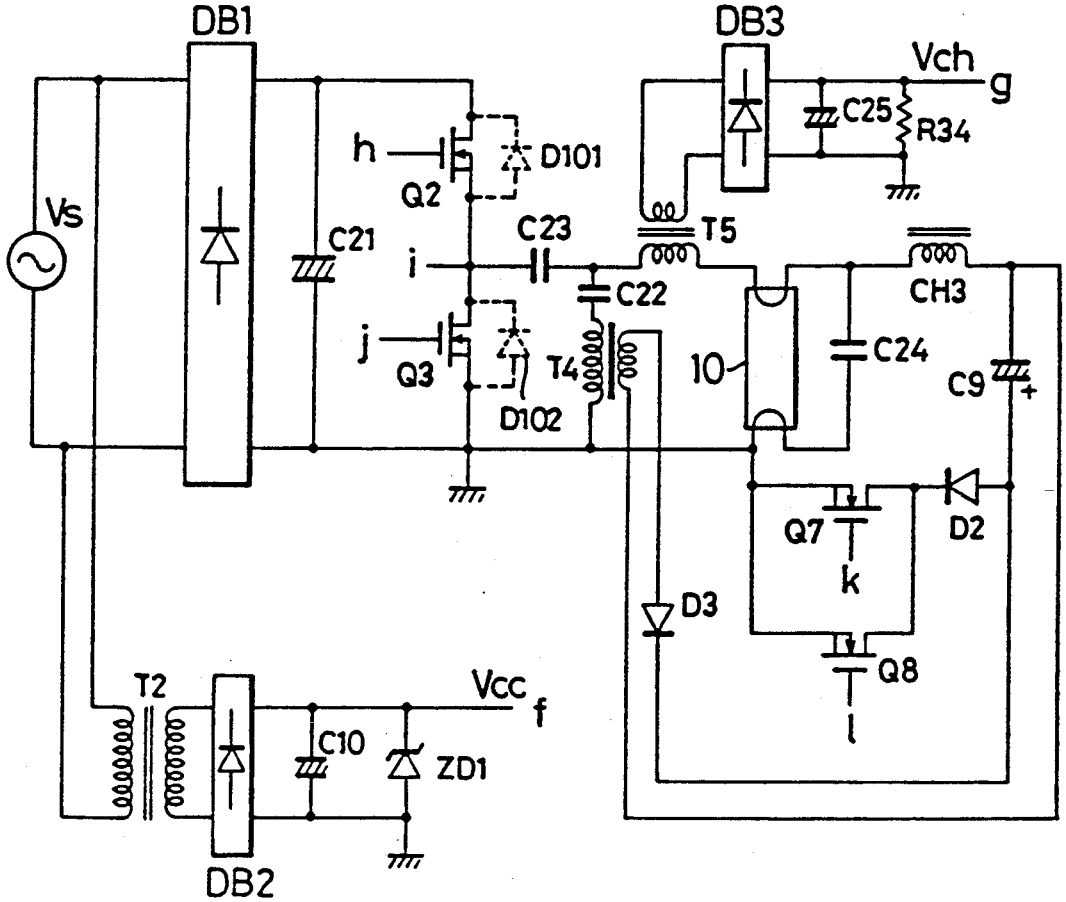
FIG. 13 is a detailed circuit diagram for a main circuit in the device of FIG. 12.

The device in the embodiment of FIG. 12 shall be further detailed with reference to FIG. 13 showing a main circuit of the device of FIG. 12 in which the same constituents as those in FIG. 4 of the main circuit of the device of FIG. 1 are denoted by the same reference numerals. In the present instance, the commercial AC power source Vs is connected to AC input terminals of a diode bridge DB1 across DC output terminals of which a capacitor C21 is connected. A series circuit of MOS transistors Q2 and Q3 is connected to both ends of the capacitor C21 to be in parallel thereto. A capacitor C22 and a primary winding of a high frequency transformer T4 are connected in series through a DC component cutting capacitor C23 to the drain of the MOS transistor Q3, to which drain a source side terminal of a filament in the discharge lamp 10 is also connected through a primary winding of an inductor T5. Across non-source side terminals of the both filaments of the discharge lamp 10, a resonating and preheat current passing capacitor C24 is connected in parallel thereto. A secondary winding output of the high frequency transformer T4 is rectified by a diode D3 and smoothed by a capacitor C9, and a DC voltage is obtained. This capacitor C9 is connected at an end through a choke coil CH3 to one of the non-source side ends of the filaments of the lamp 10 and at the other end through a diode D2 and a parallel circuit of MOS transistors Q7 and Q8 to the other source side end of the other filament of the lamp 10. The choke coil CH3 is for blocking any high frequency so that the high frequency voltage applied to the discharge lamp 10 is prevented from leaking to the capacitor C9. The inductor T5 forms in combination with the capacitor C24 and LC series resonance circuit, which is to start and light the discharge lamp 10 by means of a resonance voltage generated across the capacitor C24. The capacitors C22 and C23 are for cutting the DC component and are made larger in the capacity than the capacitor C24 enough for not being contributive to the resonance. A secondary winding of the inductor T5 is connected to AC input terminals of a further diode bridge DB3 which is connected at its DC output terminals to a parallel circuit of a capacitor C25 and resistor 34, at which output terminals a voltage $V_{ch}$ corresponding to the resonance current, and this voltage $V_{ch}$ is supplied through a terminal "g" to the control circuit.

The commercial AC power source Vs is also connected through a voltage dropping transformer T2 to AC input terminals of another diode bridge DB2, to DC output terminals of which a parallel circuit of a capacitor C10 and Zener diode ZD1 is connected. A DC voltage obtained at the capacitor C10 is supplied through a terminal "f" to the control circuit. Across terminals "h" and "i" connected to the gate and source of the MOS transistor Q2, a first control signal is supplied, while a second control signal is supplied across a terminal "j" connected to the gate of the MOS transistor Q3 and the ground. These first and second control signals are the same as those in the embodiment of FIGS. 1–4, and the MOS transistors Q2 and Q3 are to carry out the same inverter operation as in the particular embodiment.

In the device of the working aspect of FIG. 13, a third control signal is supplied across a terminal "k" connected to the gate of the MOS transistor Q7 and the ground so that the MOS transistor Q7 will be made conductive by this third control signal at the time of the low light flux so as to superpose the DC power on the high frequency power to the discharge lamp 10, whereby the lamp is made not to cause any flicker-off but to be stably lighted. Further, a fourth control signal is supplied across a terminal "l" connected to the gate of the MOS transistor Q8 and the ground, so that the MOS transistor Q8 is made conductive by this fourth control signal upon the starting of the discharge lamp 10 and the starting high voltage can be effectively prevented from being applied to the MOS transistor Q7 upon the starting of the lamp.

Figures 14A, 14B:
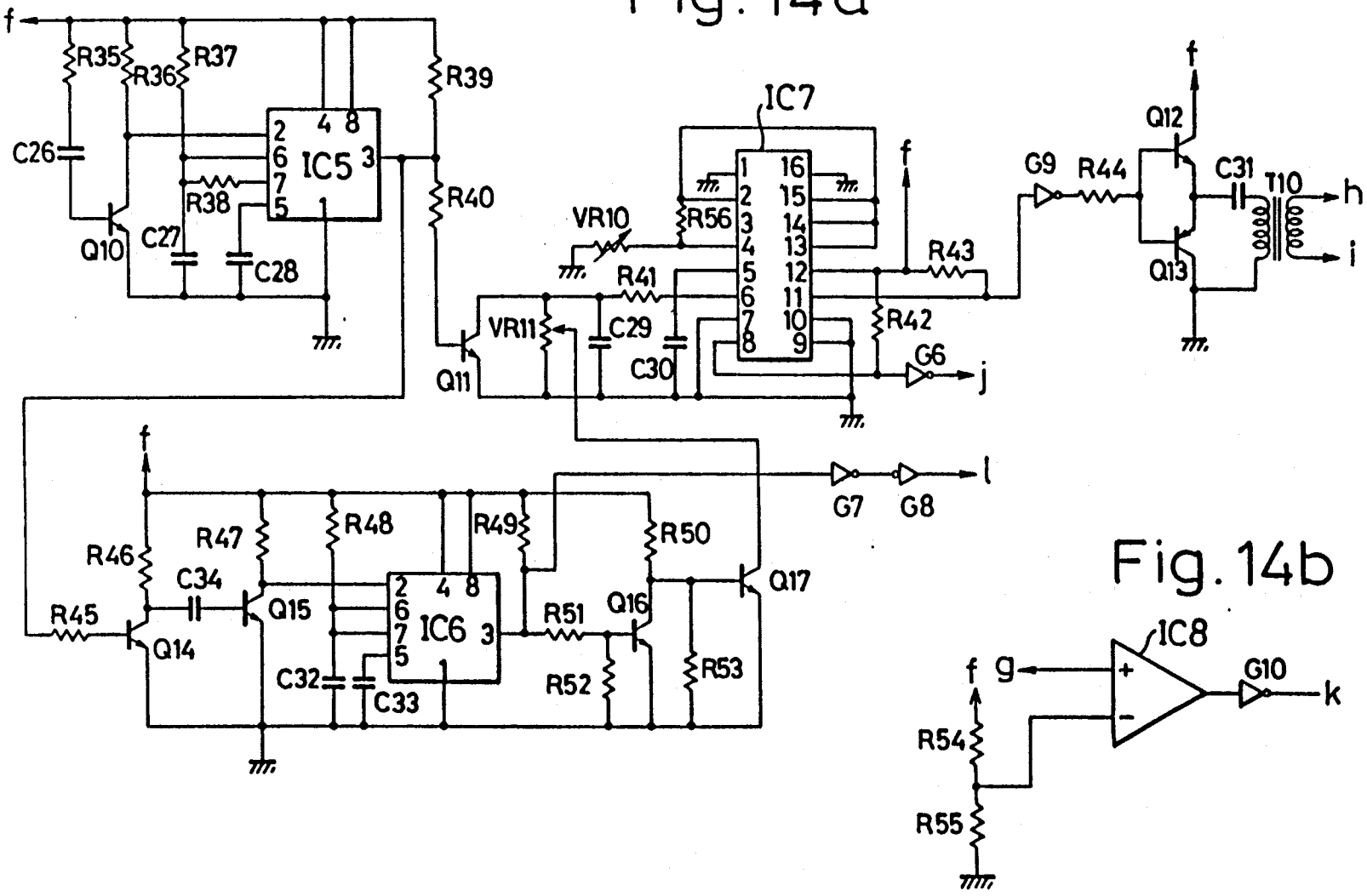
FIGS. 14(*a*) and 14(*b*) are detailed circuit diagrams for control means in the device of FIG. 12.

References shall now be made in detail to the control circuit providing the first to fourth control signals to the main circuit shown in FIG. 13, with reference to FIG. 14(*a*). To this control circuit, the low DC voltage $V_{cc}$ obtained at the capacitor C10 as a control power source is supplied through the terminal "f" as the control power source voltage. Timer circuits IC5 and IC6 as well as an oscillating circuit IC7 are actuated by this control power source voltage $V_{cc}$. The timer circuit IC5 comprises a generally used integrated circuit ("NE555" by a U.S. manufacturer SIGNETIX), which is triggered when a trigger terminal (2nd pin) is below $(\frac{1}{3})V_{cc}$, an output terminal (3rd pin) is made at "L" level and a discharge terminal (7th pin) is made to be of a high impedance. A threshold level terminal (6th pin) will be at $(\frac{2}{3})V_{cc}$, the output terminal (3rd pin) turns to be at "L" level, and the discharge terminal (7th pin) also turns to "L" level. Across a power terminal (8th pin) and ground terminal (1st pin), the control power source voltage $V_{cc}$ is applied. A reset terminal (4th pin) is connected to the power source terminal (8th pin), while a frequency control terminal (5th pin) is connected through a decoupling capacitor C28 to the ground terminal (1st pin). The control power source voltage $V_{cc}$ is also applied to a series circuit of a resistor R37 and capacitor C27 for defining a time constant of the timer circuit IC5. Junction point of the resistor R37 and capacitor C27 is connected to the threshold value terminal (6th pin) of the timer circuit IC5, and through a resistor R38 to the discharge terminal (7th pin). The timer circuit IC5 thus connected is made to operate as if the same is a monostable multivibrator.

Now, in the main circuit of FIG. 13, as the commercial AC power source Vs is connected to raise the control power source voltage $V_{cc}$ applied at the terminal "f", the capacitor C26 is thereby charged through the resistor R35, whereby a current is made to flow momentarily across the base and emitter of a transistor Q10, and this transistor Q10 is turned on in a moment, upon which a potential at a junction point between the resistor R36 and the transistor Q10 is momentarily dropped, the trigger terminal (2nd pin) of the timer circuit IC5 is made at "L" level and this monostable multivibrator IC5 is triggered. As a result, the output terminal (3rd pin) of IC5 maintains its "H" level until the threshold terminal (6th pin) reaches a predetermined threshold value voltage $Vth=(\frac{2}{3})V_{cc}$, in accordance with the time constant of the capacitor C27 and resistor R37. Also, as the voltage at the capacitor C27 reaches the threshold voltage Vth, the output terminal (3rd pin) comes to "L" level, the discharge terminal (7th pin) turns to "L" level as well, and the charge at the capacitor C27 is discharged through the resistor R38. In this case, the output terminal (3rd pin) is made at "H" level for about 1 sec. depeding on the set time constant of the capacitor C27 and resistor R37.

When the output terminal (3rd pin) of the timer circuit IC5 is at "H" level, a base current is made to flow through resistors R39 and R40 to a transistor Q11 to turn it on. A base current is also made to flow through resistors R39 and R45 to a transistor Q14 to turn it on. As the output terminal (3rd pin) of the timer circuit IC5 becomes "L" level, the both transistors Q11 and Q14 are turned off.

The timer IC6 also comprises such integrated circuit as the "NE555" of the SIGNETIX, and the control power source voltage $V_{cc}$ is applied across a power source terminal (8th pin) and ground terminal (1st pin). A reset terminal (4th pin) is connected to the power source terminal (8th pin), and a frequency control terminal (5th pin) is connected through a decoupling capacitor C33 to the ground terminal (1st pin). To a series circuit of resistor R48 and capacitor C32 forming the time constant circuit of the timer circuit IC6, the control power source voltage $V_{cc}$ is applied. Junction point of the resistor R48 and capacitor C32 is connected to a threshold value terminal (6th pin) and a discharge terminal (7th pin), so that the timer circuit IC6 will operate as the monostable multivibrator.

As the timer operation of the timer circuit IC5 terminates the foregoing operation and output terminal (3rd pin) turns from "L" level to "L" level, then the transistor Q14 turns from on state to off state, whereby the collector potential of the transistor Q14 rises, the capacitor C34 is thereby charged through a resistor R46, and a current is caused to momentarily flow across the base and emitter of a transistor Q15 to turn this transistor Q15 to be on for a moment. Due to this, the potential at junction point of a resistor R47 and the transistor Q15 is momentarily lowered, trigger terminal (2nd pin) of the timer circuit IC6 is made at "L" level and this circuit is triggered as a monostable multivibrator. Thereafter, the output terminal (3rd pin) retains its "L" level until the threshold terminal (6th pin) reaches a predetermined threshold voltage $Vth=(\frac{2}{3})V_{cc}$ with the time constant of the capacitor C32 and resistor R48. As the voltage of the capacitor C32 reaches the threshold voltage Vth, the output terminal (3rd pin) is made at "L" level, and a charge in the capacitor C32 is discharged. In the present instance, the output terminal (3rd pin) of the timer circuit IC6 is at "L" level for several hundred μsec. depending on the time constant of the capacitor C32 and resistor R48.

When the output terminal (3rd pin) of the timer circuit IC6 is at "L" level, a current is caused to flow through resistors R49 and R51 across the base and emitter of a transistor Q16 to turn it on, whereby the potential at junction point of resistors R50 and R53 is caused to drop, and a transistor Q17 is turned off. As the output terminal (3rd pin) of the timer circuit IC6 comes to be at "L" level, the transistor Q16 is made off, the potential at the junction between the resistors R50 and R53 is raised, and the transistor Q17 is turned on.

For the oscillating circuit IC7, the same controlling IC for use as the switching regulator as that in the embodiment shown in FIGS. 1-4 (for example, "μPC494" by NEC) may be employed. In the present instance, the dead-off time can be set by dividing the level of the reference voltage $V_{ref}$ by means of a resistor R56 and variable resistor VR10 and inputting the divided voltage to a dead-off time control terminal (4th pin) of the oscillating circuit IC7. Non-inverting input terminals (1st and 6th pins) and inverting input terminals (2nd and 15th pins) of the circuit IC7 are input terminals for a pulse width controlling comparator and, when the pulse width control is not carried out, the circuit operates to pull down the former terminals to the ground level and to pull up the latter terminals to the level of the reference voltage $V_{ref}$. Its feedback terminal (3rd pin) is a feedback input terminal for the pulse width control and is opened when not used. Here, an output control terminal (13th pin) is subjected to a push-pull operation with respect to the level of the reference voltage $V_{ref}$ at reference voltage output terminal (14th pin), and the control signals for the MOS transistors Q2 and Q3 are made by grounding open-emitter terminals (9th and 10th pins) and subjecting oscillation outputs obtained at respective open-connector terminals (8th and 11th pins) to an invertion and wave-shaping respectively by means of pull-up resistors R42 and R43 and NOT circuits G6 and G9. An output of the NOT circuit G6 is provided as the second control signal in the main circuit through the terminal "j" to the gate of the MOS transistor Q3, while an output of the other NOT circuit G9 is insulated by means of a resistor R44 and a drive circuit comprising transistors Q12 and Q13, coupling capacitor C31 and pulse transformer T10, and is provided as the first control signal in the main circuit through the terminals "h" and "i" to the gate and source of the MOS transistor Q2.

As will be seen in FIG. 14(*b*), a reference voltage divided by resistors R54 and R55 out of the control power source voltage $V_{cc}$ is applied to an inverted input terminal of such comparator IC8 as shown herein, while the voltage $V_{ch}$ corresponding to the resonance current detected at the main circuit is applied to the other non-inverted input terminal. An output of this comparator IC8 is inverted at a NOT circuit G10 and is supplied through the terminal "k" to the gate of the MOS transistor Q7 as the third control signal in the main circuit. As the discharge lamp 10 is dimmed to be in the low light flux state, the voltage $V_{ch}$ is lowered to turn the output of the comparator IC8 to be at "L" level, so that the NOT circuit G10 provides an "H" level output to turn the MOS transistor Q7 to be on. When the discharge lamp 10 is not in the low light flux state, on the other hand, the MOS transistor Q7 is in the off state. The voltage at the output terminal (3rd pin) of the timer circuit IC6 is subjected to a waveform shaping through a buffer circuit comprising NOT circuits G7 and G8, and is supplied to the gate of the MOS transistor Q8 through the terminal "1" as the fourth control signal in the main circuit.

Figure 15:
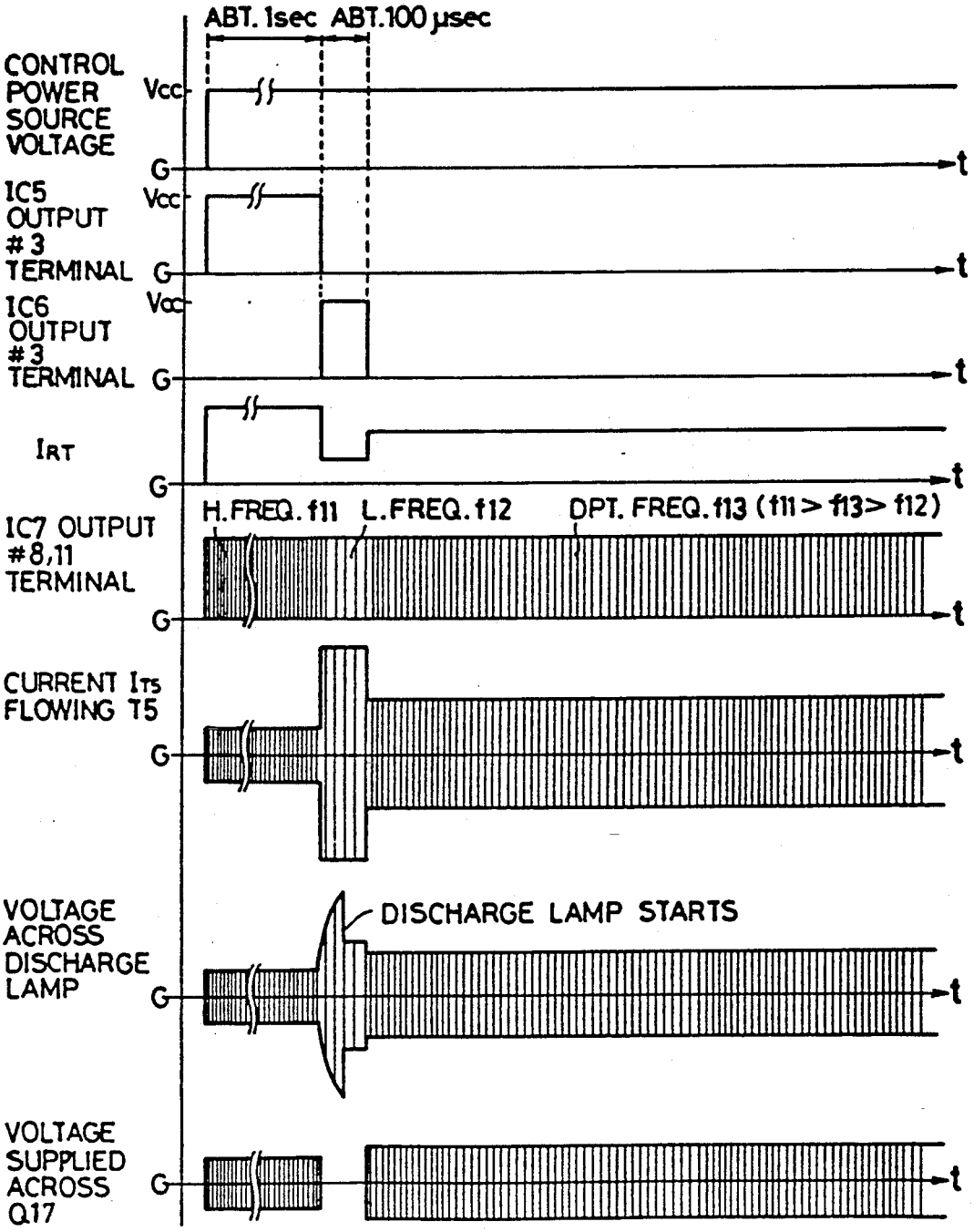
FIG. 15 is a diagram showing waveforms at respective parts in the circuit of FIG. 14.

Referring to the operation of the foregoing arrangement of FIGS. 14(*a*) and 14(*b*) with also reference to FIG. 15, the timer circuit IC5 actuated by the commercial AC source voltage Vs causes the transistor Q11 turned on for about 1 sec., during which a current $I_{RT}$ is limited only by the resistor R41 and the oscillating frequency f11 of the oscillating circuit IC7 is elevated. The oscillating frequency f11 at this time is set to be sufficiently higher than a resonating frequency upon no load state of the load circuit, and the voltage applied across the discharge lamp is low, whereby the discharge lamp 10 is not started and the preheat current is fed to the filaments for about 1 sec. As the timer operation of the timer circuit IC5 terminates, the transistor Q11 is turned off, and thereafter the transistor Q17 is made in off state for several hundred μsec., due to which the current $I_{RT}$ is limited by the resistor R41 and variable resistor VR11, and the oscillating circuit IC7 is made to oscillate at a lower oscillating frequency f12. A capacitor C29 is connected in parallel to the variable resistor VR11 for a smooth variation of the oscillating frequency. The oscillating frequency f12 at this time is set to be close to the resonating frequency upon the no load state of the load circuit, so that the voltage applied across the discharge lamp 10 becomes very high, the discharge lamp is thereby started to proceed the discharging.

As the timer operation of the timer circuit IC6 terminates, the transistor Q17 is then turned on, and the variable resistor VR11 is connected at its slider to a ground point, due to which the current $I_{RT}$ is limited by the resistor R41 and a part of the variable resistor VR11, and the oscillating circuit IC7 is made to oscillate at an oscillating frequency f13 which is optional with a range of f11<f13<f12. By operating the slider of this variable resistor VR11, the oscillating frequency f13 can be made either high or low. With the oscillating frequency f13 made higher, the resonating action becomes weaker to reduce the resonating current, and the flux of light generated by the discharge lamp 10 is lowered. In this way, the dimming of the discharge lamp 10 can be realized.

In the foregoing main circuit, the resonance current $T_{T5}$ flowing through the inductor T5 is to be detected as the voltage $V_{ch}$ and, when this detected voltage value becomes below a predetermined level, the comparator IC8 provides an "L" level output while the NOT circuit G10 provides an "H" level output, to render the MOS transistor Q7 to be in ON state. Thereby, the DC power is superposed to be supplied to the discharge lamp 10, to enable any flicker-off at the low light flux state to be prevented from occurring, and the lamp can be stably lighted. When the discharge lamp 10 is not in the low light flux state, on the other hand, the MOS transistor Q7 is rendered to be in OFF state, the flow of the DC power is blocked, so that the cataphoresis phonomenon, deterioration in the durability of the lamp or the like problem can be prevented from occurring. Further, the MOS transistor Q8 connected in parallel with the MOS transistor Q7 for the DC power control is to be made in ON state upon the starting of the discharge lamp 10, that is, for the period of several hundred μsec. in which the output terminal (3rd pin) of the timer circuit IC6 is at "H" level. Consequently, the voltage across the MOS transistor Q7 is made zero for the period in which the high voltage for starting of the discharge lamp 10 is applied to the lamp, so that any stress or the like can be prevented from being imposed due to the overvoltage application.

While in the device of FIG. 14 the arrangement has been made to detect the resonance current as the means for detecting the discharge lamp 10, it is likewise possible to arrange the device for a detection of the lamp current or directly of the optical output. For the control of the MOS transistors Q7 and Q8, it will be also possible to utilize the dimming level setting signal.

Figure 16:
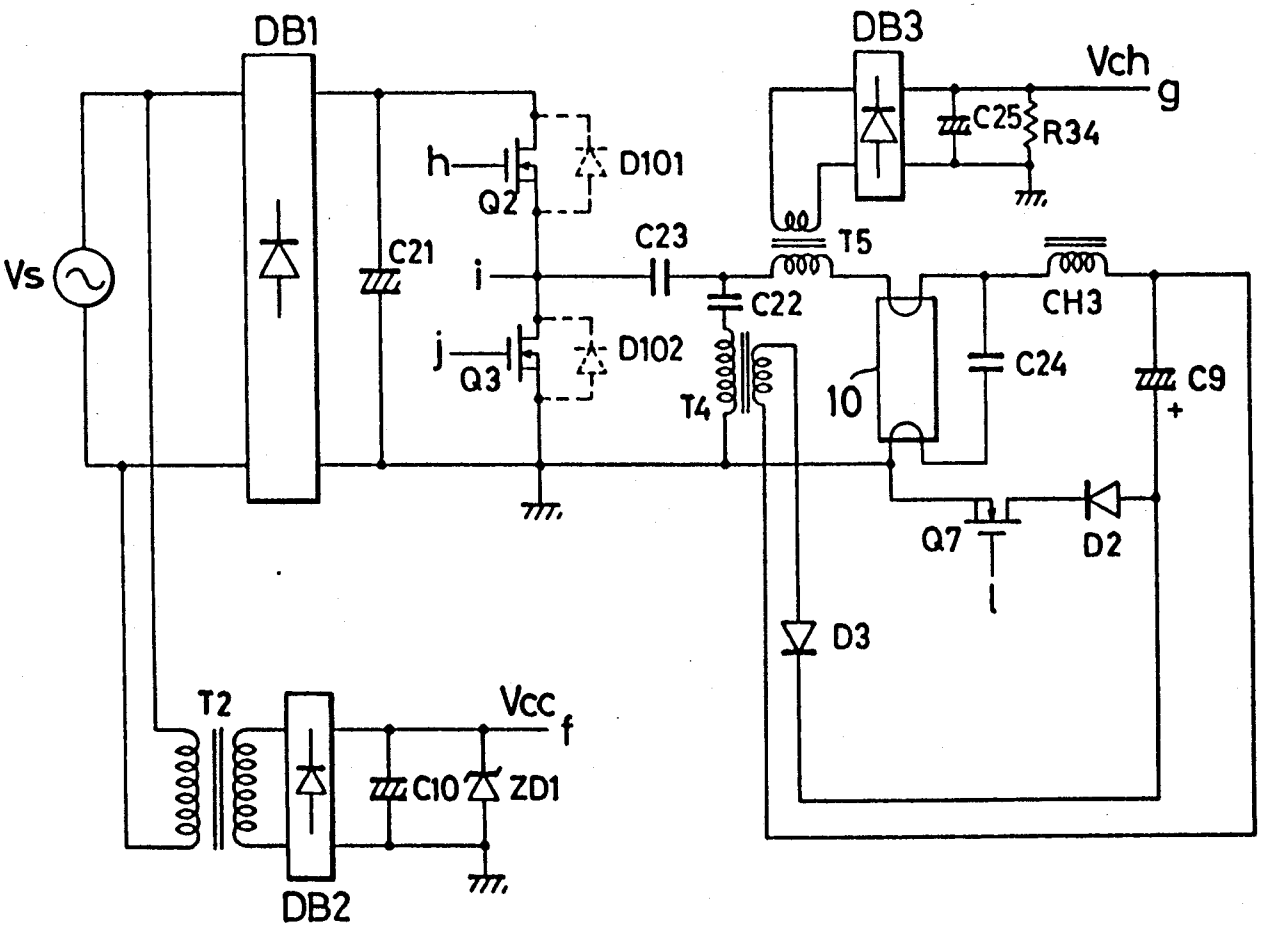
FIG. 16 is a detailed circuit diagram for a main circuit in another working aspect of the device shown in FIG. 12.
Figure 17:
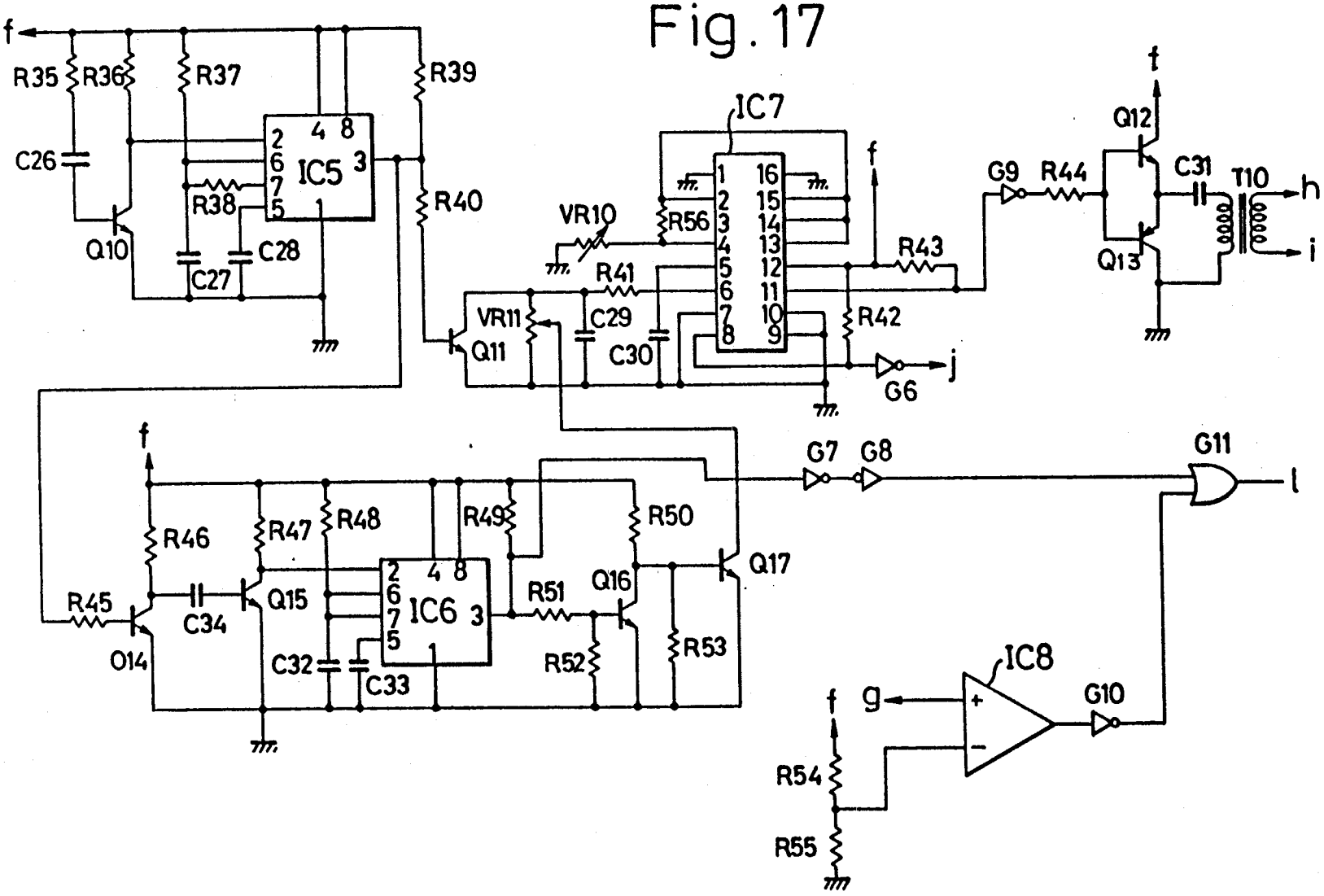
FIG. 17 is a detailed circuit diagram for a control means in still another working aspect of the device of FIG. 12.

In FIG. 16, another working aspect of the device of FIG. 13 is shown, in which the DC current controlling MOS transistor Q7 and the overcurrent preventing MOS transistor Q8 in the working aspect of FIG. 14 are commonly achieved by a single transistor which is denoted also by the reference Q7. In FIG. 17, a controlling circuit therefor is shown in detail. More specifically, the arrangement is so made here that the outputs of the NOT circuits G8 and G7 are input into the OR circuit G7, and the output of this OR circuit G11 is supplied through the terminal "1" to the gate of the MOS transistor Q7, so that the other MOS transistor Q8 in the foregoing aspect of FIG. 14 can be omitted. That is, the DC power controlling MOS transistor Q7 in the present instance is made in ON state not only upon the low light flux but also upon the starting of the discharge lamp 10, and the other MOS transistor Q8 is not required to be separately provided for the overvoltage prevention purpose. In the present aspect, other arrangements and functions are substantially the same as those in the aspect of FIG. 14.

While in the above working aspect of FIGS. 16 and 17 the reference has been made to the MOS transistor to be used for the purpose of the DC power control or the overvoltage prevention, it is possible to employ, if required, such other switching element as a bipolar transistor or even a relay or the like may be commonly employed.

Figure 18:
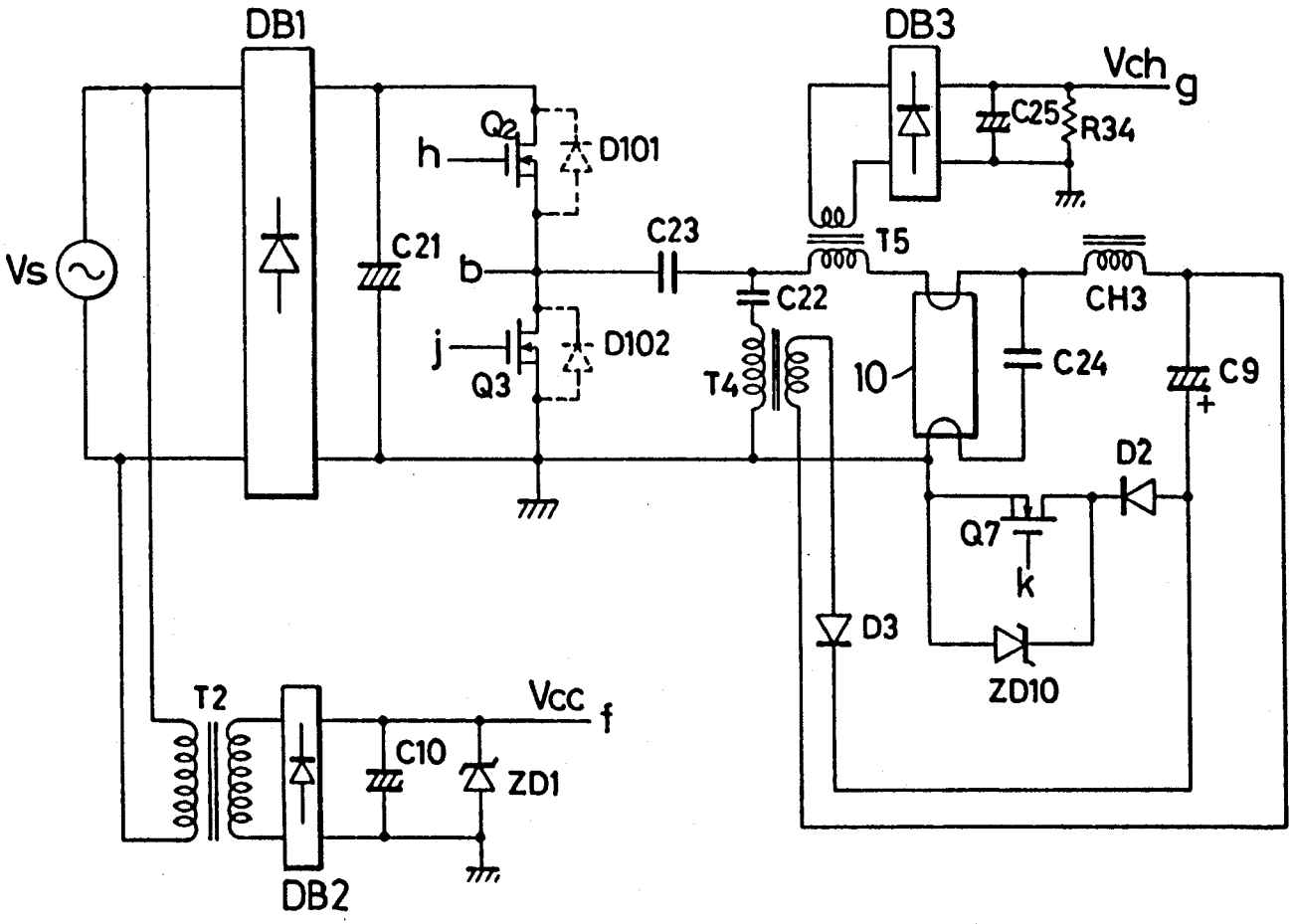
FIG. 18 is a detailed circuit diagram of yet another working aspect of the device of FIG. 12.

In FIG. 18, there is shown still another working aspect of the device of FIG. 13. In the present instance, a Zener diode ZD10 is employed as the switching element for the high voltage prevention to be connected in parallel to the MOS transistor Q7 for the DC power controlling, and this Zener diode ZD10 has a Zener voltage set to be lower than the breakdown voltage across the drain and source of the MOS transistor Q7 but to be higher than the voltage applied during the lighting. Therefore, the Zener diode ZD10 is to be made conductive only upon the starting of the discharge lamp 10, so that any overvoltage can be prevented from being applied across the MOS transistor Q7. Further, with a passive high voltage preventing element employed here, the control circuit can be simplified and economized in contrast to such active element as the MOS transistor. In place of the foregoing Zener diode ZD10, it will be also possible to use such surge absorber as ZNR, or such passive element as avalanche diode. Other arrangements and functions in the present aspect are substantially the same as those in the aspect of FIG. 14.

Figure 19:
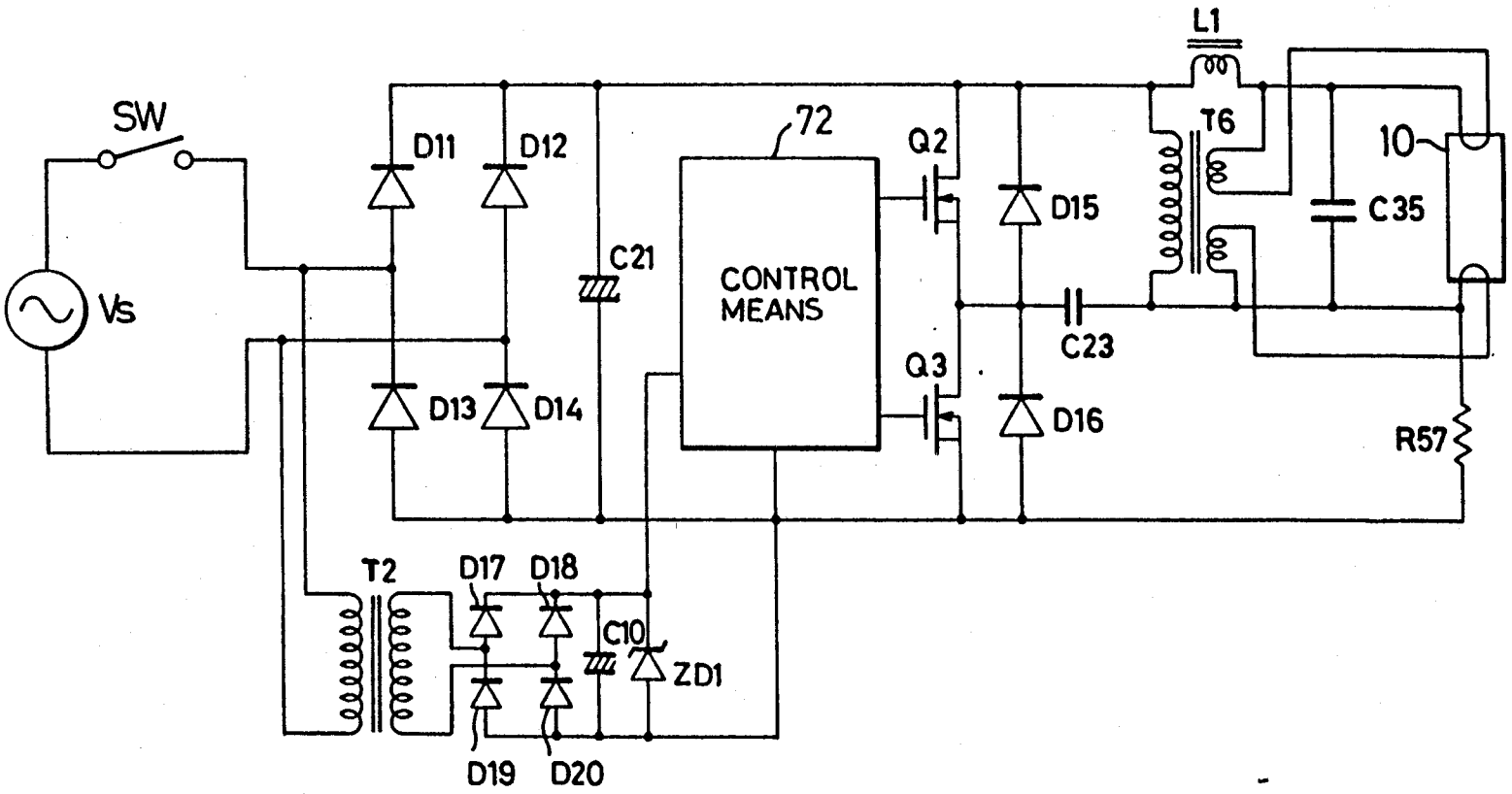
FIG. 19 shows in a circuit diagram yet another embodiment of the discharge lamp lighting device according to the present invention.

According to yet another feature of the present invention, there is suggested a discharge lamp lighting device which immediately stops the superposed supply of DC power upon lighting off of the discharge lamp 10. Referring to FIG. 19 showing another working aspect of the device of FIG. 1 according to the present invention, the control power source voltage $V_{cc}$ of the capacitor C10 which is an activating power source for a control means 72 is lowered when a power source switch $SW_{AC}$ is opened in a state where the discharge lamp 10 is dimming-controlled in the low light flux zone, for example, but the control means 72 outputs the control signal until the voltage reaches a level below the minimum voltage $V_{MIN}$ at which circuit elements of the control means 72 can still be activated, as shown in FIG. 20*a*. The voltage of the capacitor C21 which is the main power source of the inverter is also lowered, but the discharge lamp 10 maintaining its lighting in the low light flux zone is small in the consumed power so that, as in FIG. 20*b*, the voltage $V_{C21}$ of the capacitor C21 is gradually lowered. Since the DC power for maintaining the lighting is being supplied to the lamp from the capacitor C21 through the resistor R57, further, the lighting of the discharge lamp 10 is easy to be maintained even when the source switch $SW_{AC}$ is opened. Provided here that the discharge lamp 10 is maintained in the lighting state until the voltage $V_{C21}$ of the capacitor C21 reaches below a predetermined voltage Vo, the operation of the control means 72 ceased at a timing t1 still allows the discharge lamp 10 to be kept lighted until a timing t2, as in FIG. 2.

When on the other hand the source switch $SW_{AC}$ is opened in fully lighted state of the discharge lamp 10, the consumed power at the inverter is large enough for quickly lowering the voltage $V_{C21}$ of the capacitor C21, as in FIG. 20*c*. In an event where, as in FIG. 20*d*, the control means 72 stops its operation and the voltage $V_{C21}$ of the capacitor C21 still remains above the predetermined voltage Vo at the timing t1 at which the oscillation of the inverter has stopped, the voltage $V_{C21}$ is to be gradually lowered thereafter, and the discharge lamp 10 is to be kept lighted until a timing t3 at which the voltage $V_{C21}$ is below the predetermined level Vo.

Figure 22:
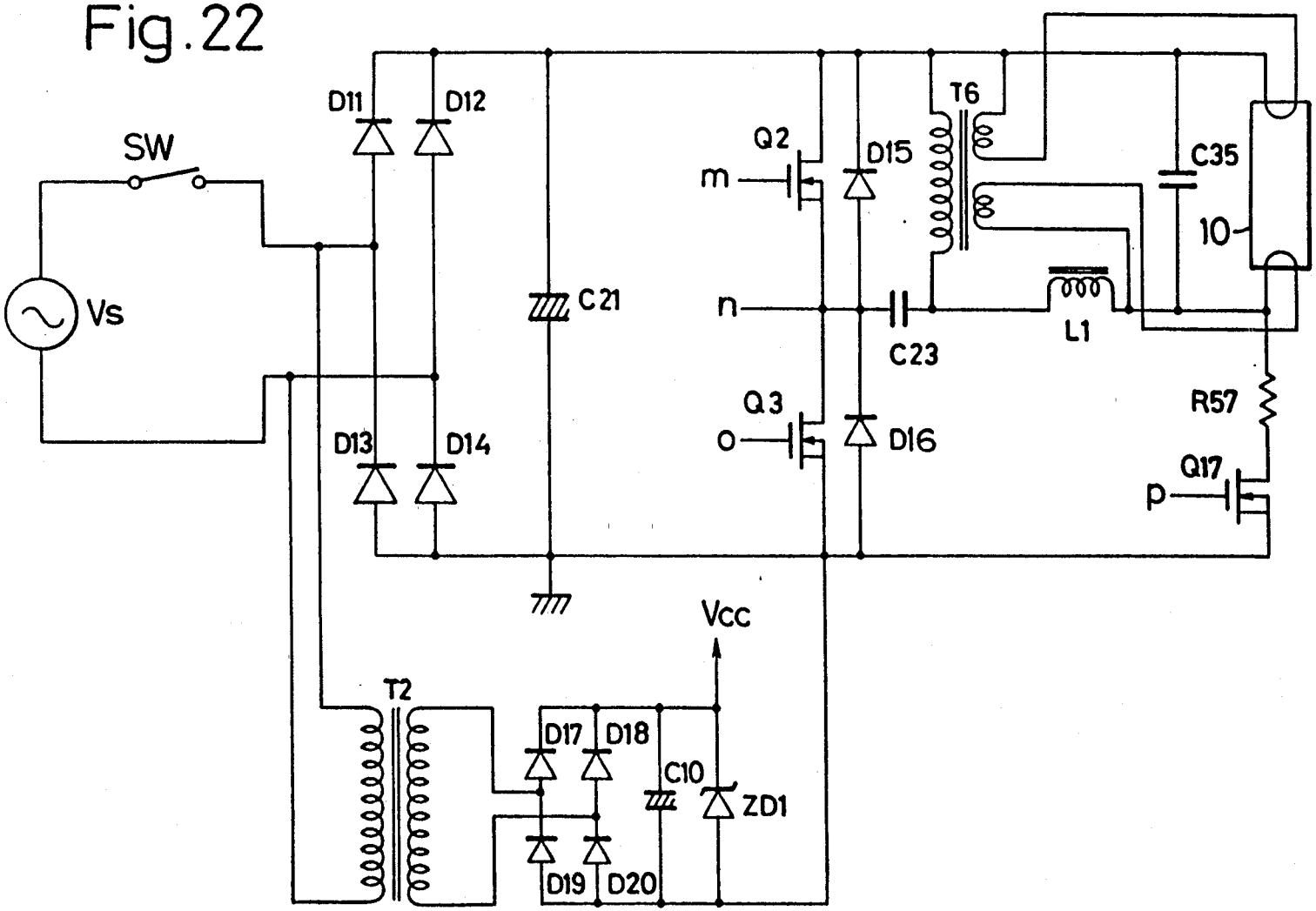
FIG. 22 is a detailed diagram for a main circuit in the device of FIG. 21.

Accordingly, in an embodiment for working the present freature, the arrangement is so made as to provide a discharge lamp lighting-off signal S11 to the DC power supplying means 73, as shown in FIG. 21, for stopping the DC power supply immediately after the lighting-off of the discharge lamp 10. More concretely, as shown in FIG. 22, a MOS transistor Q17 is inserted in series with a resistor R57 so that the MOS transistor Q17 will be turned off by providing a signal P to the gate of this transistor and the DC power supplying path will be thereby broken. In the embodiment of FIGS. 21 and 22, other arrangements and functions are substantially the same as those in the case of FIGS. 1 and 19.

Figure 23:
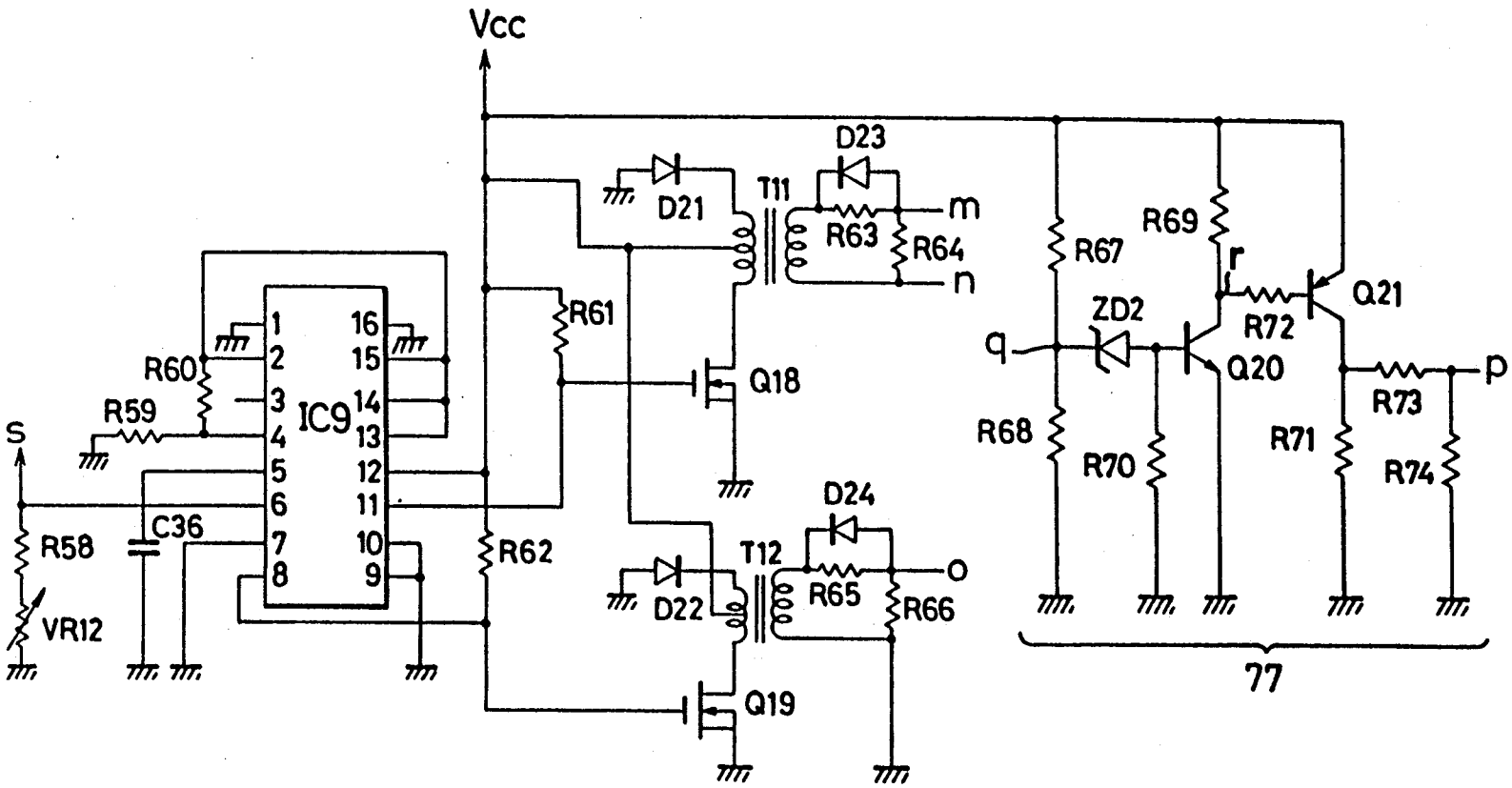
FIG. 23 is a detailed circuit diagram of a control means in the device of FIG. 21.

In FIG. 23, there is shown a concrete example of the control means for supplying the control signals to the main circuit of FIG. 22, in which example there are provided driving circuits for the MOS transistors Q2 and Q3 in the main circuit, and an oscillating circuit IC9 for providing the drive signals to these driving circuits, and a voltage detecting circuit 77 for a turning-off control of the MOS transistor Q7 upon the lighting-off of the discharge lamp 10 is further provided. As operating power source for these circuits, the control power source voltage $V_{cc}$ obtained at the capacitor C10 in the control power source is supplied to the circuits. The driving circuit for the MOS transistor Q2 comprises a pulse transformer T11, resistors R63 and R64 and diodes D21 and D23. To center tap of primary winding of the pulse transformer T11, the control power source voltage $V_{cc}$ is provided, while the primary winding is grounded at one end through a later detailed driving MOS transistor Q18 and at the other end through the diode D21. Secondary winding of the pulse transformer T11 is connected at one end through a terminal "n" to the source of the MOS transistor Q2 in the main circuit and at the other end through the resistor R63 for normal biasing, the diode D23 for reverse biasing and a terminal "m" to the gate of the MOS transistor Q2. The resistor R64 is connected in parallel across the gate and source of the MOS transistor Q2.

Now, as the driving MOS transistor Q18 is made ON and the pulse transformer T11 is grounded at one end, a current is caused to flow through the primary winding by the control power source voltage $V_{cc}$ applied to the center tap of the primary winding of the transformer T11, a thereby induced current in the secondary winding is made to flow through a series circuit of the resistors R63 and R64 connected to the secondary winding, and a voltage is generated across the resistor R64, which voltage normally biases across the gate and source of the MOS transistor Q2 to turn this transistor ON.

As the driving MOS transistor Q18 is turned OFF and the current flowing through the primary winding of the pulse transformer T11 is interrupted, there arises a regenerative current made to flow through the diode D21 to the control power source for keeping the current to flow through the primary winding. At this time, a reverse electromotive force is generated in the secondary winding of the pulse transformer T11, a voltage reversely biasing between the gate and source of the MOS transistor Q2 is generated across the resistor R64 through the diode D23, the accumulated charge in the capacity between the gate and source is rapidly discharged and the MOS transistor Q2 is quickly turned OFF. The driving circuit for the MOS transistor Q3 is of the same arrangement and the same operation is carried out. This driving circuit for the MOS transistor comprises a pulse transformer T12, resistors R65 and R66 and diodes D22 and D24, which respectively correspond to the pulse transformer T11, resistors R63 and R64 and diode D21 and D23, and the same operation is realized. For the oscillating circuit IC9, the controlling IC for use with the switching regulator ("μPC494C" by NEC) may be employed, and the same function as in the foregoing embodiment is attained.

In the present embodiment, a push-pull operation is carried out by pulling up output control terminal (13th pin) of the oscillating circuit IC9 to a level of the reference voltage $V_{ref}$, open emitter terminals (9th and 10th pins) are grounded, and oscillation outputs obtained at open collector terminals (8th and 11th pins) are made to be input signals respectively to the driving MOS transistors Q18 and Q19. That is, when a short-circuit state is made between the first open collector terminal (8th pin) and the open emitter terminal (9th pin), the gate of the MOS transistor Q19 is at "L" level but, when an open state is attained between these terminals, the gate of the MOS transistor Q19 will be made at "H" level by the pull-up resistor R62. Similarly, the gate of the MOS transistor Q18 is at "L" level upon the short-circuit state between the second open collector terminal (11th pin) and open emitter terminal (10th pin) but is at "H" level upon the open state between these terminals. The MOS transistors Q18 and Q19 are connected as in the above respectively to one end of each of the pulse transformers T11 and T12 in the driving circuits for the MOS transistors Q2 and Q3 forming the inverter circuits, for driving the MOS transistors Q2 and Q3.

The oscillating frequency of the oscillating circuit IC9 is determined by the time constant of a capacitor C36, fixed resistor R58 and variable resistor VR12. With the value of the variable resistor VR12 properly regulated, therefore, it is made possible to control the oscillating frequency of the oscillating circuit IC9. Further, the dead-off time of the oscillation output is determined by a divided voltage level of the reference voltage $V_{ref}$ by resistors R59 and R60.

In the voltage detecting circuit 77, on the other hand, the control power source voltage $V_{cc}$ obtained at the capacitor C10 is divided by resistors R67 and R68, and a voltage attained at junction point between these resistors R67 and R68 is applied through a Zener diode ZD2 to a resistor R70. A voltage generated across the resistor R70 is applied across the base and emitter of a transistor Q20, a collector of which is pulled up through a resistor R69 to the control power source voltage $V_{cc}$ and connected through a resistor R72 to a base of a PNP transistor Q21. The control power source voltage $V_{cc}$ is provided to an emitter of the PNP transistor Q21 while its collector is grounded through a resistor R71. A series circuit of resistors R73 and R74 is connected in parallel across the resistor R71, and a voltage attained at junction point p between these resistors R73 and R74 is used as a gate driving voltage for the MOS transistor Q17 in the main circuit shown in FIG. 22.

Figure 24A:
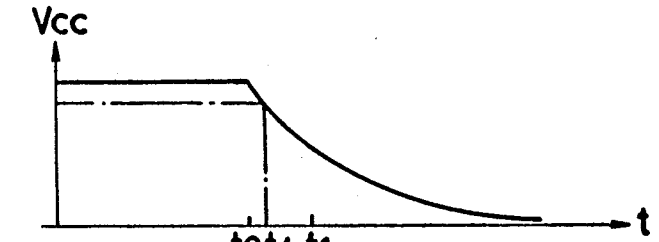
FIGS. 24(*a*) to 20(*c*) are operational waveform diagrams for the device of FIG. 21.
Figure 24B:
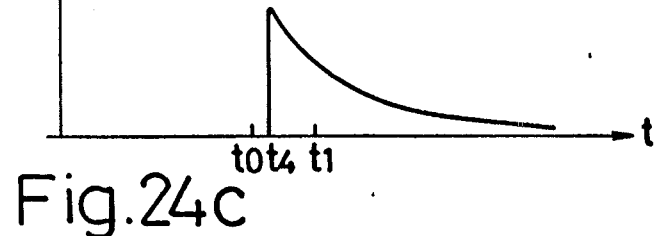
Figure 24C:
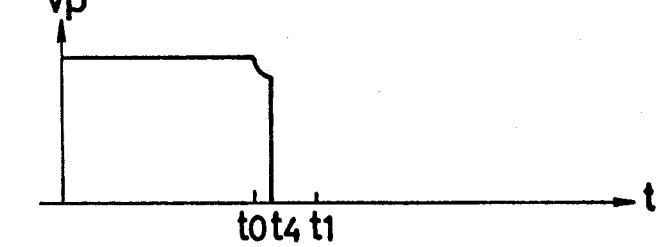

FIGS. 24a–24c show operational waveforms in the voltage detecting circuit 77 shown in FIG. 23, in which the power source switch $SW_{AC}$ is closed prior to a timing t0, and a predetermined constant DC voltage determined by the Zener voltage of the Zener diode ZD1 is generated across the capacitor C10. The voltage attained at the junction point q is obtained by dividing this predetermined constant DC voltage by means of the resistors R67 and R68, and is set to be higher than the Zener voltage of the Zener diode ZD2. Therefore, the Zener diode ZD2 is made conductive prior to the timing t0 to generate a voltage across the resistor R70, the transistor Q20 is thereby turned on, and a collector voltage Vr at a point r of the transistor Q20 will be at "L" level, as shown in FIG. 24b in comparison with the control power source voltage $V_{cc}$ shown in FIG. 24a. Further, a base current flows to the PNP transistor Q21 through a resistor R72 and the transistor Q20 so that the PNP transistor Q21 will be turned on, a potential at the junction point p between the resistors R73 and R74 will become a voltage determined in accordance with the control power source voltage $V_{cc}$ as shown in FIG. 24c, and the MOS transistor Q17 in the main circuit is turned on, due to which a direct current is made to flow through the resistor 57 to the discharge lamp 10.

When the source switch $SW_{AC}$ is opened at the timing t0, the control power source voltage $V_{cc}$ is lowered as shown in FIG. 24a and, when the voltage at the point q becomes lower than the Zener voltage of the Zener diode ZD2 upon the timing of t4, the Zener diode ZD2 is turned into non-conducting state, whereby the transistor Q20 is turned off and its collector voltage Vr will coincide to the control power source voltage $V_{cc}$ as shown in FIG. 24b. Therefore, the PNP transistor Q21 is turned off, the potential at the junction point p between the resistors R73 and R74 will be at "L" level as shown in FIG. 24c, and the MOS transistor Q18 in the main circuit is turned off. Accompanying this, the direct current flowing through the resistor R57 to the discharge lamp 10 is interrupted. As the oscillating circuit IC9 ceases its operation, the inverter oscillation is stopped, and the discharging of the discharge lamp 10 is stopped. At this time, no direct current is made to flow through the discharge lamp 10 for maintaining its lighting, and no after-glow is persistent.

While in the present embodiment the voltage drop in the control power source voltage $V_{cc}$ is detected to obtain the lighting-off signal for the discharge lamp, it may be also effective to detect the drop in the voltage at the capacitor C21 forming the inverter input power source, or the lighting-off signal may also be obtained by means of another switch interlocked with the power source switch $SW_{AC}$.

Figure 25:
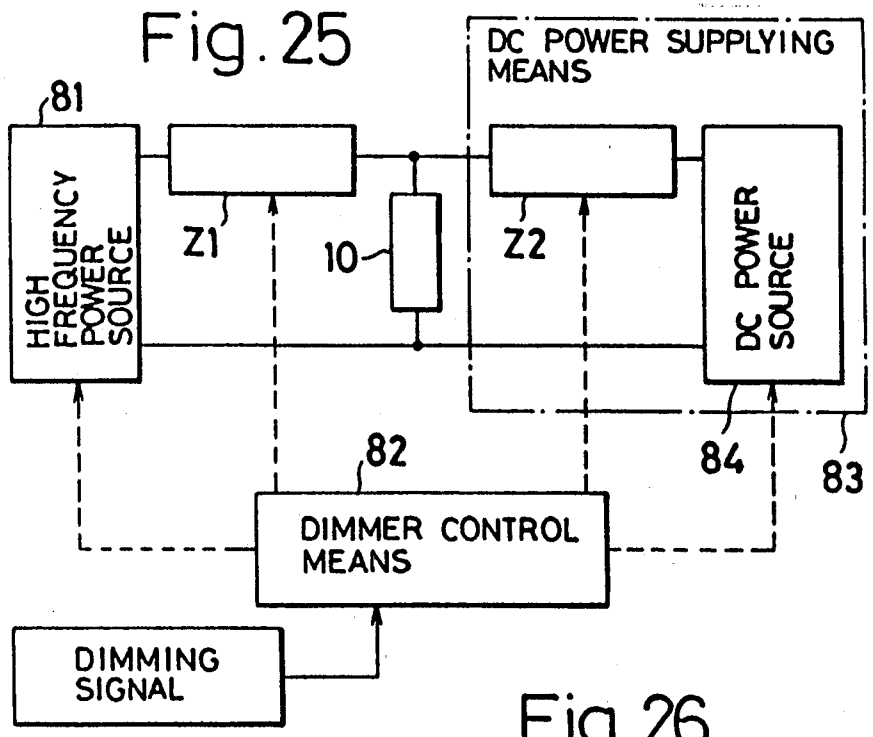
FIG. 25 is a block diagram of another working aspect of the device of FIG. 19.
Figure 26:
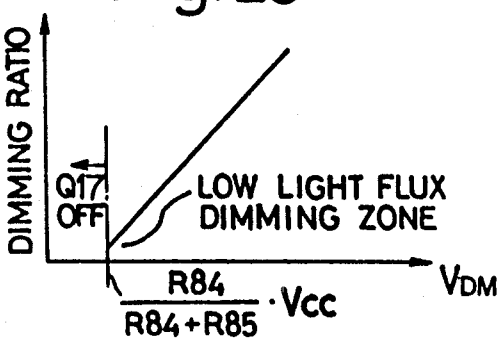
FIG. 26 is a diagram for explaining the operation of the device of FIG. 25.

Referring next to FIG. 25, another embodiment for realizing the present feature is shown, in which the arrangement is so made that the dimmer control means 82 allows the optical output of the discharge lamp 10 to be controllably dimmed in a range from 100% lighting to 0% lighting, i.e., lighting-off, in response to the dimming signal $V_{DM}$. In the present instance, a fade-out is to be carried out by breaking the DC power for maintaining the lighting of the discharge lamp. In this case, as shown in FIG. 26, the dimming ratio decreases as the dimming signal $V_{DM}$ decreases, to render the optical output to be smaller and, as the dimming signal $V_{DM}$ reaches a predetermined level, the DC power for maintaining the lighting of the discharge lamp is interrupted, to render the dimming ratio to be zero and the optical output to disappear.

Figure 27:
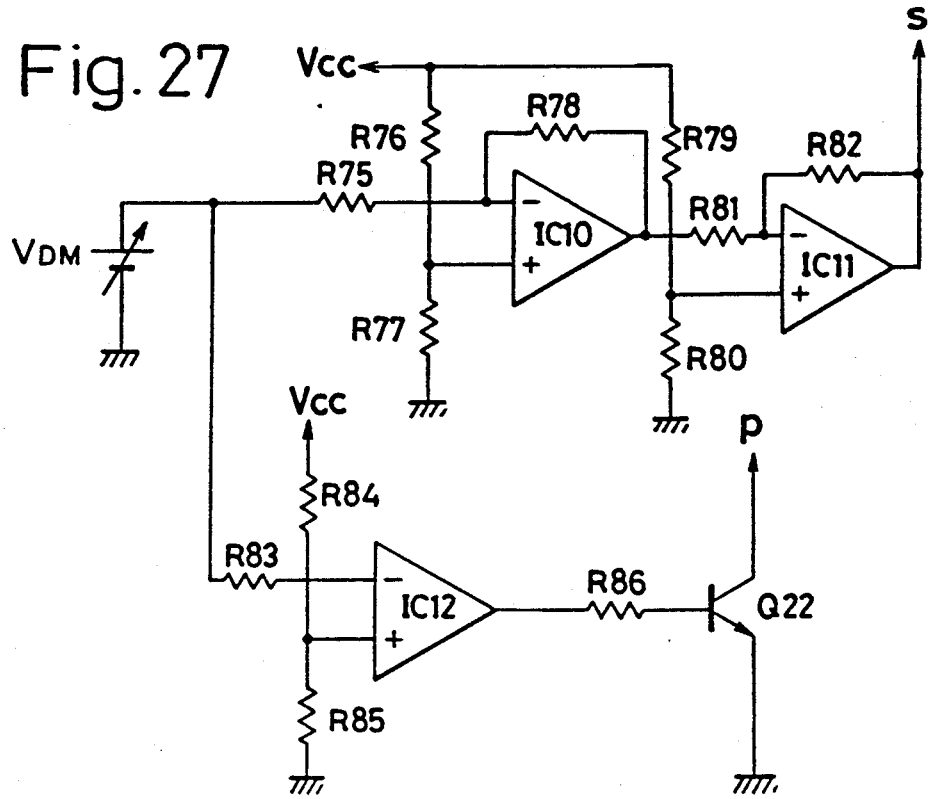
FIG. 27 is a circuit diagram of a main part of the device of FIG. 25.

In FIG. 27, there is shown a fade-out control circuit to be used together with the main circuit of FIG. 22 and the control circuit of FIG. 23, and terminals "p" and "s" shown in FIG. 27 are to be connected to the terminals "p" and "s" in FIG. 23, respectively. Here, the dimming signal $V_{DM}$ is input into an inverted input terminal of an operational amplifier IC10 through an input resistor R75, while a reference voltage divided out of the control power source voltage $V_{cc}$ by resistors R76 and R77 is supplied to non-inverted input terminal of the operational amplifier IC10, an output terminal of which is connected through a feedback resistor R78 to the inverted input terminal of the amplifier IC10 and through an input resistor R81 to an inverted input terminal of another operational amplifier IC11. To non-inverted input terminal of this operational amplifier IC11, a reference voltage obtained by dividing the control power source voltage $V_{cc}$ by resistors R79 and R80 is applied, and an output terminal of the amplifier IC11 is connected through a feedback resistor R82 to its own inverted input terminal and through the terminal "s" to the resistor terminal (6th pin) of the foregoing oscillating circuit IC9 of FIG. 23. The dimming signal $V_{DM}$ is thus provided through the operational amplifiers IC10 and Ill to the resistor terminal (6th pin) of the oscillating circuit IC9, and the dimmer control can be realized. In this case, it should be appreciated that the arrangement is so made that higher the dimming signal $V_{DM}$, larger the optical output of the discharge lamp 10 obtained.

Further, the dimming signal $V_{DM}$ is also provided through a resistor R83 to an inverted input terminal of a comparator IC12 to a non-inverted input terminal of which a reference voltage divided out of the control power source voltage $V_{cc}$ by resistors R84 and R85 is applied. This comparator IC12 is connected at an output terminal through a resistor R86 to the base of a transistor Q22 which is connected through the terminal "p" across the resistor R74 of FIG. 23 in parallel thereto. When, as in FIG. 26, the dimming signal $V_{DM}$ is larger than a predetermined level $\{R84/(R84+R85)\}\cdot V_{cc}$, the output terminal of the comparator IC12 is at "L" level and the transistor Q22 is in OFF state. As the dimming signal V becomes smaller than the above predetermined level, the output terminal of the comparator IC12 turns to "H" level to render the transistor Q22 to be turned on. Consequently, the MOS transistor Q17 in the main circuit of FIG. 22 is forcibly turned off, and the DC power supplied through the resistor R57 to the discharge lamp 10 for maintaining the discharge is interrupted, whereby the discharge lamp 10 is made no more possible to retain the discharge in the low light flux dimming zone as shown in FIG. 26, and the discharge lamp is reliably completely lighted off. In the arrangement of the present embodiment, therefore, the lighting-off of the discharge lamp is realized without employing any of such measures apt to impose excessive stress to the circuit elements as an interruption of input power to the inverter, ceasing of oscillation of the inverter or the like, but rather by reducing the inverter oscillation output and interrupting the DC power supply for the discharge retention, while continuing the inverter oscillation to render any stress imposed to the circuit elements to be the minimum.

According to yet another feature of the present invention, there can be provided a dimmable discharge lamp lighting device with which such abnormal discharge state as poor electron emission (emitless) occurring at the filaments can be reliably detected so as to be able to prevent any excessive stress from being imposed to the circuit elements. That is, when the filament f2 of the discharge lamp 10 in the arrangement of FIG. 1 is involved in the emitless state, this particular state may be detected by detecting any excessive current flowing through the MOS transistors Q2 and Q3. When the other filament f1 is in the emitless state, however, the inverter does not allow any abnormality detected even the inverter itself is in the abnormal discharging state, and the normal operation is kept to be carried out to cause the excessive stress to be imposed on the circuit elements. According to the present feature, this drawback can be overcome.

Figure 28:
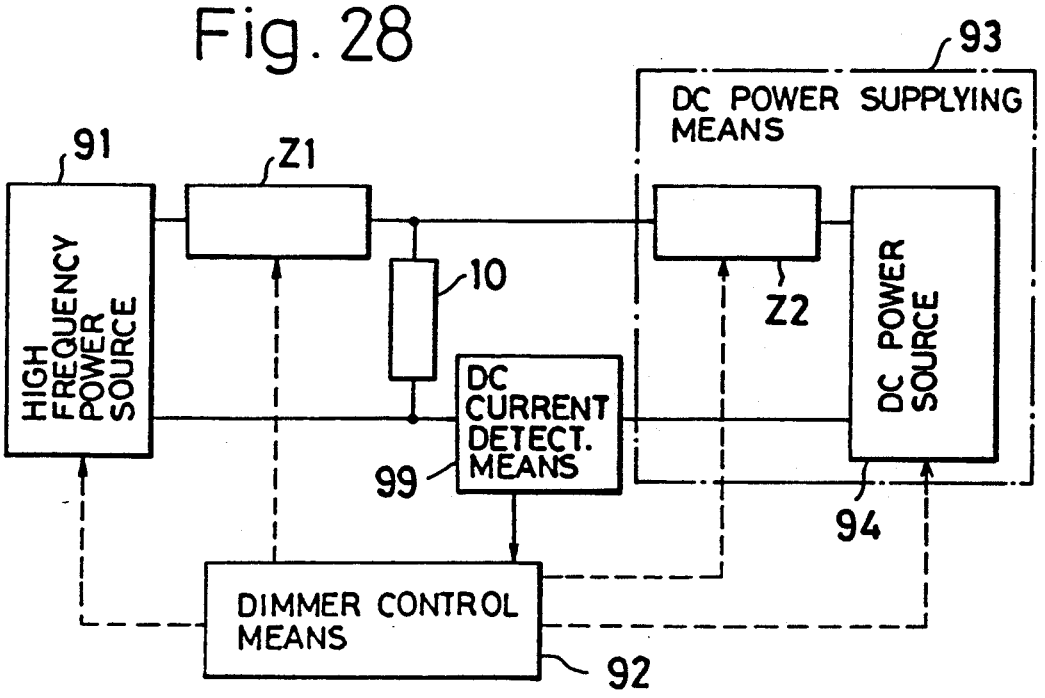
FIG. 28 is a block diagram showing still another embodiment of the dimmable discharge lamp lighting device according to the present invention.

Referring in detail to an embodiment practicing the present feature with reference to FIG. 28, the embodiment suggests an arrangement in which a DC current detecting means 99 is inserted between the discharge lamp 10 and the DC power supplying means 13 in the embodiment of FIG. 1, the latter means being denoted by a numeral 93 here, so that any larger DC current than that in the case of normal lighting and detected by the means 99 will be provided as an abnormal discharge signal to the dimmer control means 92. In this case, the arrangement may be so made that the stopping of the high frequency power supply from the high frequency power source 91 to the discharge lamp 10 in response to the detection of the abnormal discharging, or the relighting control for the discharge lamp in response to the detection of non-lighting of the lamp can be carried out. The dimmer control means 92 may be of the same arrangement as that in FIG. 1 adapted to be capable of dimming the discharge lamp from the arc discharge zone to the glow discharge zone. Other arrangements and functions are the same as those in the foregoing embodiments.

Figure 29A:
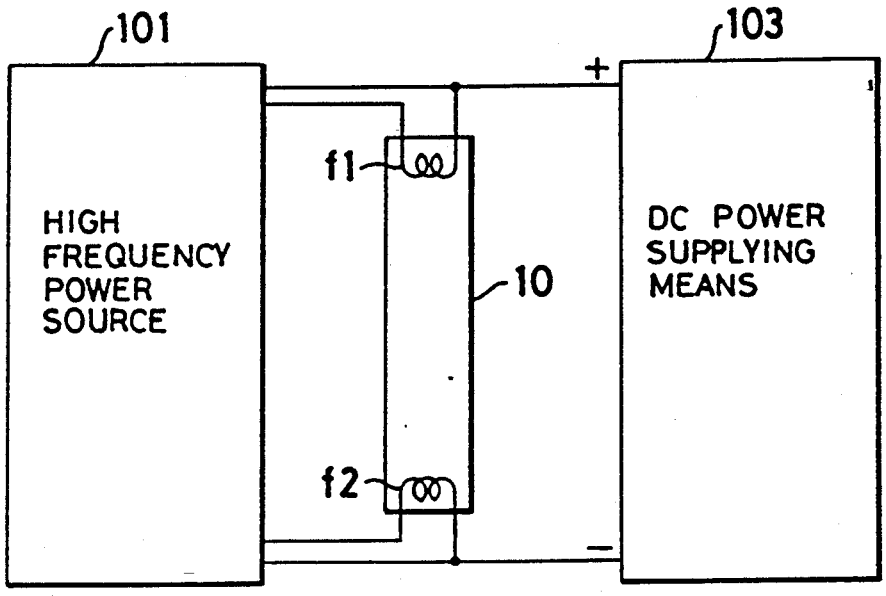
FIGS. 29(*a*) and 29(*b*) are explanatory views for the device of FIG. 28.
Figure 29B:
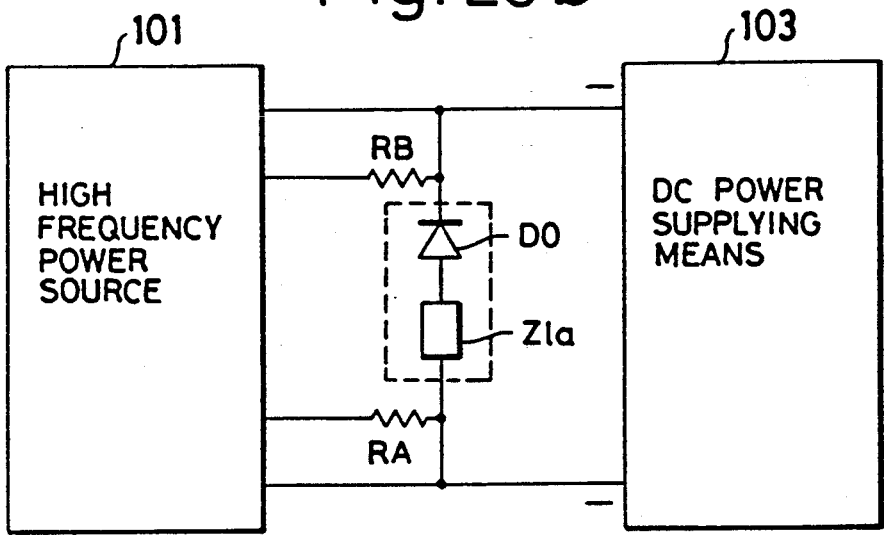

Referring more specifically to the above with reference to FIGS. 29*a* and 29*b*, it should be assumed here that the high frequency power is supplied from the high frequency power source 101 to the discharge lamp 10 and the DC power is applied from the DC power supplying means 103 to the discharge lamp 10 as superposed on the high frequency power, and that the filament f2 on minus side of the DC power is involved in the emitless state, then the lamp current flowing through the lamp 10 is caused to flow substantially only from the filament f2 to the filament f1. This should be for reason that electrons are emitted substantially only from the filament f1 due to that the electrons can hardly be emitted from the filament f2 as no emitter from the filament f2 is present. As will be clear when an equivalent circuit as in FIG. 29*b* to that of FIG. 29*a* is referred to, the high frequency power is to be applied to the discharge lamp 10 through the filaments f1 and f2 having resistors RB and RA, and the discharge lamp 10 itself is regarded as comprising a diode DO and a lamp impedance Z1*a* with a half-wave rectification assumed in view of a single directional lamp current flow upon occurrence of the emitless state at the filament f2. When the emitless state has occurred at the filament f2, the current flows from the filament f2 to the filament f1 as represented by the direction of the assumed diode DO here, so that an overcurrent is thereby caused to flow through a switching element in the high frequency power source 101 to increase that heat value, or to enlarge the stress on the circuit elements, which can be easily detected. In the event where the emitless state has taken place at the filament f1, the direction of the assumed diode DO is reversed from that in FIG. 29*b*, so that the lamp current will flow only from the filament f1 to the filament f2, the current supply from the DC power supplying means 103 is made possible. The stress imposed on the circuit elements of the high frequency power source 101 in this event is small enough for not allowing any known emitless detector to detect the situation. In the present embodiment, it has been noticed that the lamp current is supplied from the DC power supplying means 103 in the emitless state occurring at the filament f1, any increase in the supplied DC power amount from the means 103 is detected in order to achieve the intended purpose.

Figure 30:
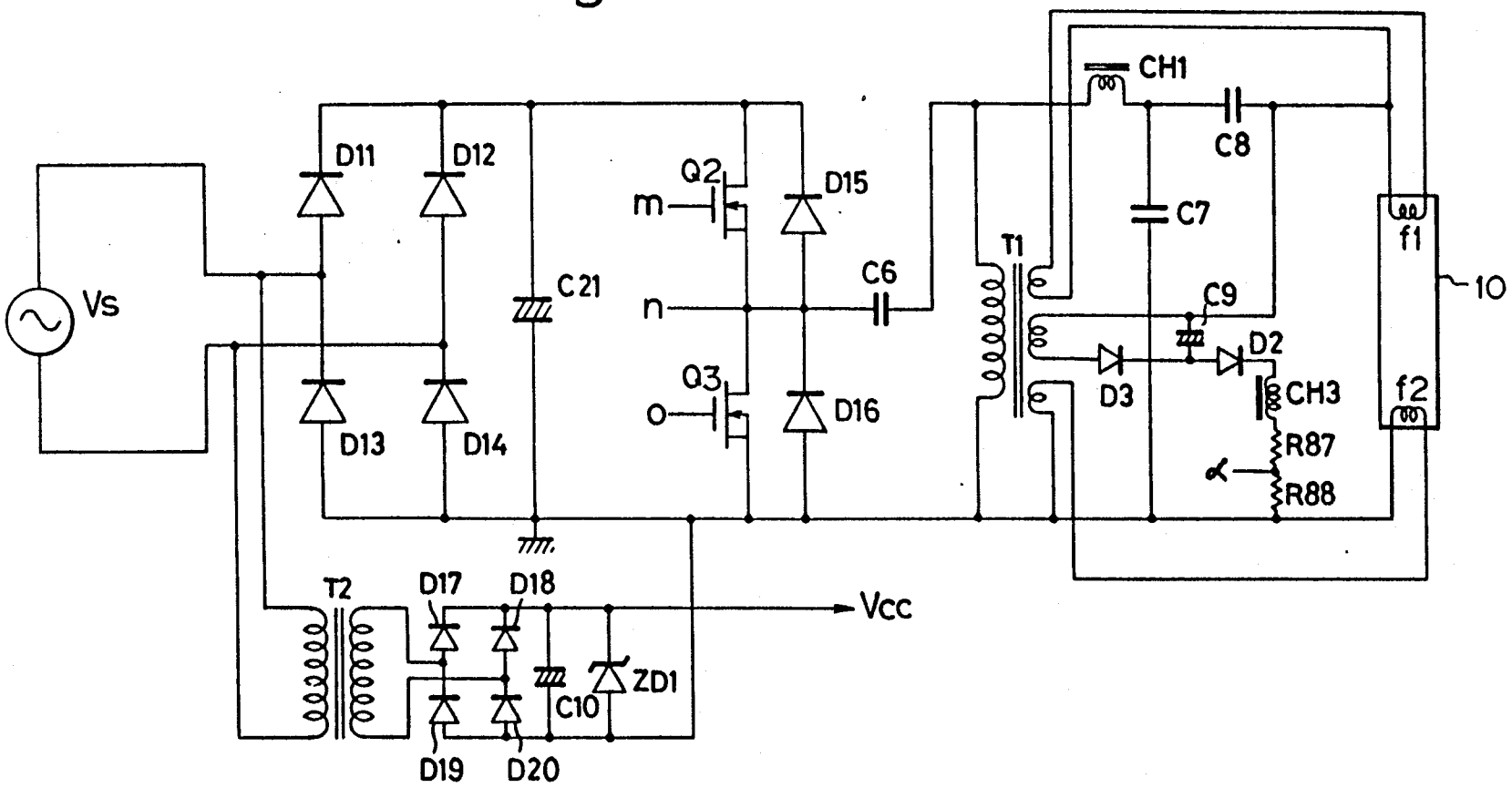
FIG. 30 is a detailed circuit diagram showing the main part of the device of FIG. 28.
Figure 31:
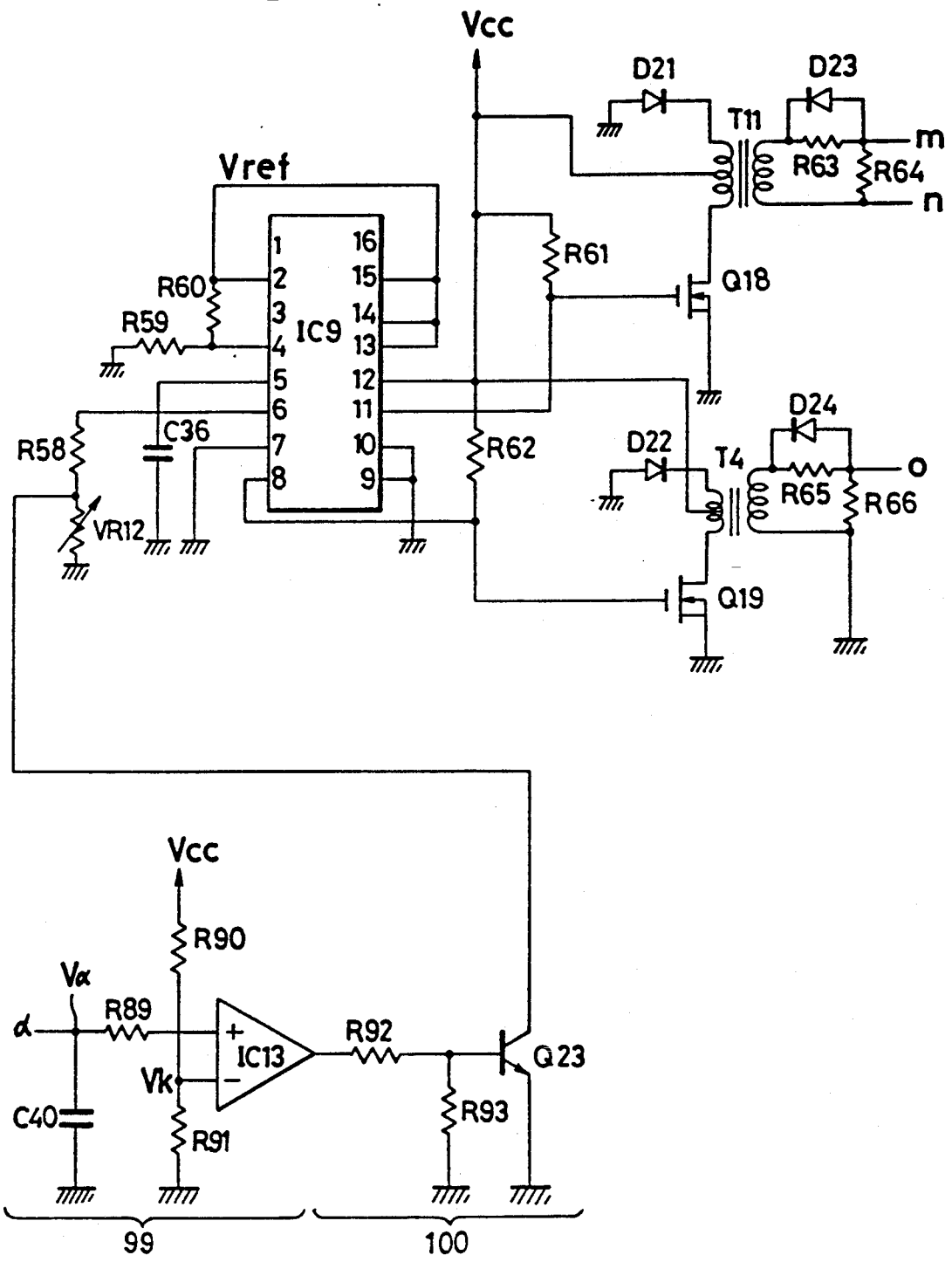
FIG. 31 is a detailed circuit diagram for a control means in the device of FIG. 28.

Referring more specifically to the embodiment of FIG. 28 by reference to FIG. 30 showing an example of circuit arrangement, current detecting resistors R87 and R88 are connected in series to the inductor CH3 which forms the DC current supply path toward the discharge lamp 10, and the magnitude of the DC current supplied to the discharge lamp 10 is detected as a potential at a point "$\alpha$" between these resistors. FIG. 31 is a concrete example of a control circuit for supplying the control signal to the main circuit of FIG. 30, in which drawings all other arrangements than that for the DC current detection and their functions are substantially the same as those in the foregoing embodiments.

In practice, in the DC current detecting means 99, a voltage $V_\alpha$ obtained at the point "$\alpha$" in the main circuit of FIG. 30 is averaged by a capacitor C40 and is applied through an input resistor R89 to a non-inverted input terminal of a comparator IC13, while a reference voltage Vk divided out of the control power source voltage $V_{cc}$ by resistors R90 and R91 is applied to the other inverted input terminal of the comparator IC13. So long as the discharge lamp 10 is normally being lighted, the voltage $V_{60}$ at the pint "$\alpha$" is lower than the reference voltage Vk to keep an output of the comparator IC13 at "L" level. Whenever the emitless state occurs at the filament f1 of the lamp 10, the DC current flowing to the lamp 10 is increased, the voltage $V_\alpha$ at the point "$\alpha$" is elevated to be above the reference voltage Vk, and the comparator output turns to "H" level. The output of the DC current detecting means 99 is provided to an oscillation limiting means 100 comprising a transistor 23 and resistors R92 and R93, the transistor Q23 being connected at the collector to a junction point between a resistor R58 and a variable resistor VR12 for setting the time constant of an oscillating circuit IC9, at the emitter to the ground and at the base through the resistor R92 to output terminal of the DC current detecting means 99 and through the resistor R93 to the ground. As the output of the DC current detecting means 99 is at "H" level, a base current flows to the transistor Q23, the same is conducted across the collector and emitter, and the variable resistor VR12 is short-circuited between its both ends, whereby the frequency of the oscillating circuit IC9 is raised, oscillating output of the inverter is restricted and the stress imposed to the circuit elements of the inverter is reduced.

Figure 32:
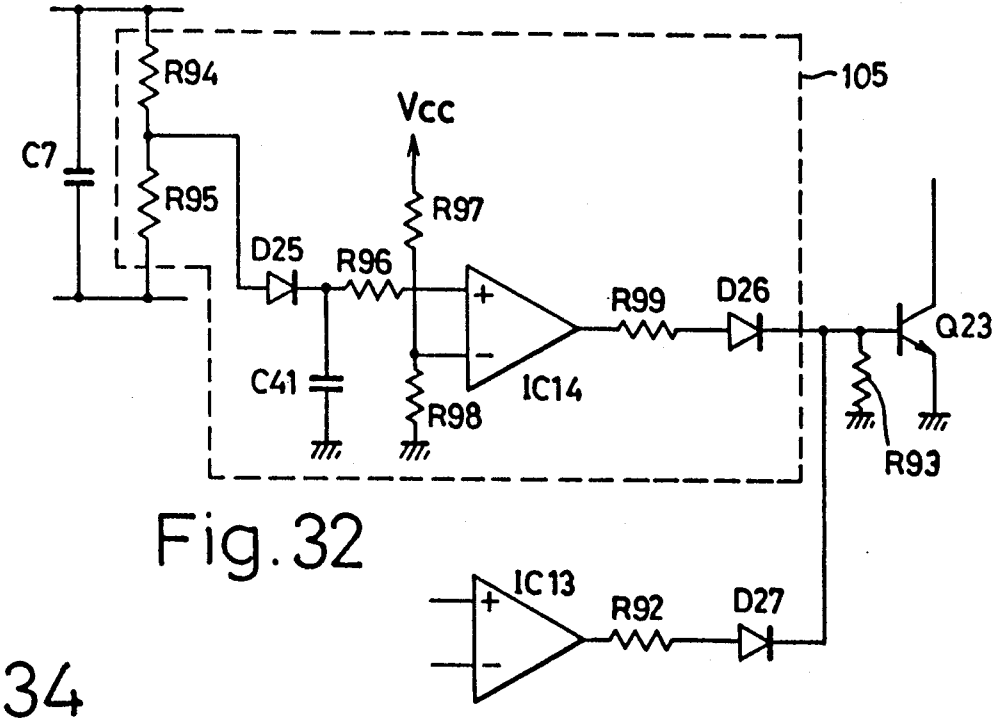
FIG. 32 is a circuit diagram of the main part in another aspect of the device of FIG. 28.

In FIG. 32, another working aspect of the device of FIG. 28 is shown, in which the emitless state not only at the filament f1 but also at the filament f2 is made detectable by providing a resonance voltage detecting means 105, in which a series circuit of voltage dividing resistors R94 and R95 is connected in parallel across a capacitor C7. A resonance voltage of a high frequency as divided by the resistors R94 and R95 is half-wave rectified at a diode D25, smoothed at a capacitor C41 and converted into a DC voltage, which is applied through an input resistor R96 to a non-inverted input terminal of a comparator IC14, while a reference voltage divided out of the control power source voltage $V_{cc}$ by resistors R97 and R98 is applied to the other inverted input terminal of the comparator IC14. During the normal lighting of the discharge lamp 10, the DC voltage from the capacitor C41 is lower than the reference voltage from the resistor R98, and the output of the comparator IC14 is at "L" level. Once the emitless state occurs at the filament f2, only a single directional current is made to flow through a resonance circuit formed by the inductor $L_{CH1}$ in the main circuit, capacitor C7, discharge lamp 10 and the like, and the resonance voltage generated across the capacitor C7 is raised to be a very high voltage. Due to this, the voltage obtained at the capacitor C7 becomes higher than the reference voltage at the resistor R98, and the comparator output becomes "H" level. This comparator output is input through a resistor R99 and diode D26 to the base of the transistor Q23. Similarly to the foregoing aspect, the output of the comparator IC13 is input through the resistor R92 and a diode D27 to the base of the transistor Q23. The diodes D26 and D27 are forming an OR circuit so that, either when the output of the resonance voltage detecting means 105 is at "H" level or when the output of the DC current detecting means 99 is at "H" level, the transistor Q23 in the oscillation limiting means 100 is turned on. According to the present working aspect, therefore, the detection of the emitless state occurring either at the filament f1 or at the filament f2 is made possible, and the oscillation output of the inverter means is limited upon occurrence of the emitless state.

Figure 33:
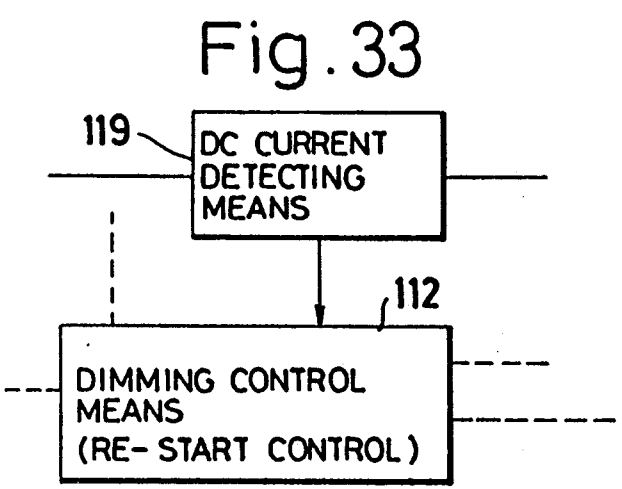
FIG. 33 is a block diagram of another aspect of the device of FIG. 28.
Figure 34:
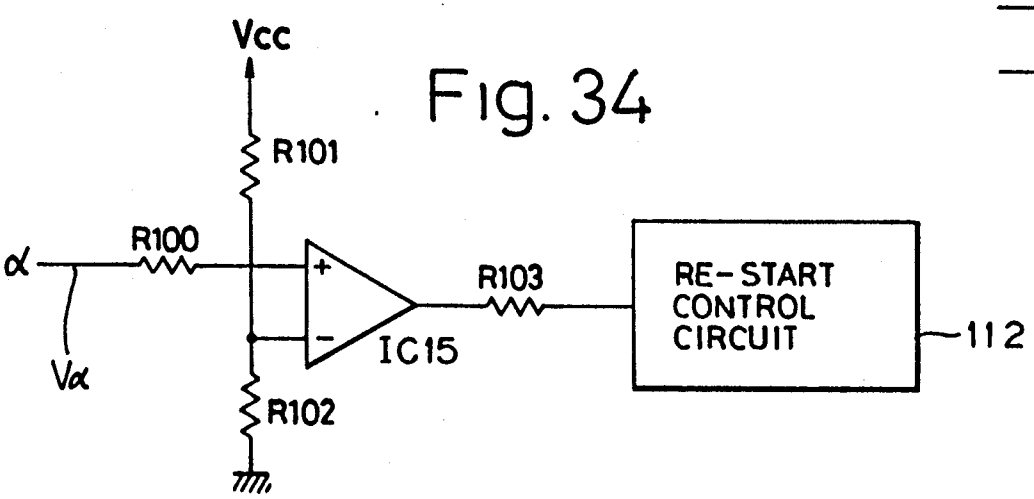
FIG. 34 is a circuit diagram showing the main part of the device in FIG. 33.

In FIGS. 33 and 34, there are shown further working aspects of the device of FIG. 28, in which aspects the arrangement is so made that, when the DC current expected to be supplied to the discharge lamp 10 is not detected, a false-start signal is provided from the DC current detecting means 119 to the dimmer control means 112, for carrying out a re-start control. More concretely, as shown in FIG. 34, the voltage $V_\alpha$ at the point "α" is applied through an input resistor R100 to the non-inverted input terminal of the comparator IC15, a reference voltage out of the control power source voltage $V_{cc}$ by resistors R101 and R102 is applied to the inverted input terminal of the comparator IC15, and the both voltages are compared. The output of the comparator IC15 is input through a resistor R103 to a re-start control circuit 112, upon which the reference voltage applied to the inverted input terminal of the comparator IC15 is set to be a lower value than the voltage $V_\alpha$ at the point "α" for the normal lighting of the discharge lamp, whereby the normal lighting of the lamp renders the output of the comparator IC15 to be at "H" level but non-lighting of the lamp turns the output to "L" level. When the output of the comparator IC15 is at "L" level, therefore, the re-start control circuit 112 provides a predetermined voltage to, for example, the oscillating circuit IC to render the switching frequency of the inverter means closer to the resonance frequency of the load circuit, a voltage good enough for starting the discharge lamp 10 is generated across a resonating capacitor C, and the discharge lamp is thereby re-started.

While in the foregoing embodiments the low-intension, mercury-arc discharge lamp has been disclosed with a premise that the lamp is dimmed, the present invention is not required to be limited to the one for dimming the discharge lamp. The important is that the lighting of the low-intension, mercury-arc discharge lamp in the discharge range where the lighting has been normally difficult is enabled to be effectively and stably realized.

What is claimed is:

1. A discharge lamp lighting device comprising a low-intensity, mercury-arc discharge lamp, a high frequency power source supplying high frequency power to said discharge lamp, means for controlling the high frequency power supplied to said discharge lamp, and a DC power supplying means for supplying DC power to said discharge lamp of a level capable of maintaining discharge upon low light flux lighting, the DC power being superposed on the high frequency power supplied to said lamp from said high frequency power source, said DC power supplying means including superposing stopping means for substantially stopping superposing of DC power when the relative illumination ratio of said lamp with respect to illumination at rated current is above a predetermined level.

2. The device according to claim 1 wherein said superposing stopping means comprises a plurality of switching circuits which are connected mutually in parallel with respect to said discharge lamp, and said relative illumination ratio above said predetermined level is set to be different for each of said switching circuits.

3. The device according to claim 1 wherein said superposing stopping means includes a DC power controlling switching means for substantially stopping said DC power superposing when said relative illumination ratio exceeds a predetermined level.

4. The device according to claim 3 which further comprises overcurrent preventing switching means connected in parallel to said DC power controlling switching means for conducting upon starting of said discharge lamp.

5. The device according to claim 4 wherein said DC power controlling switching means and said overcurrent preventing switching means are formed by a common switching means.

6. The device according to claim 1 which further comprises means for substantially stopping said superposing of said DC power in response to a signal for turning off said discharge lamp.

7. The device according to claim 1 wherein further comprises abnormality detecting means for detecting an abnormal state of said discharge lamp by detecting DC power supplied to said discharge lamp from said DC power supplying means.

8. The device according to claim 7 which further comprises means for stopping said supply of said high frequency power to said discharge lamp from said high frequency power source when said abnormality detecting means detects an abnormal state.

9. The device according to claim 1 which further comprises means for detecting a non-lighted state of said discharge lamp by detecting the level of DC power supplied to said discharge lamp from said DC power supplying means.

10. The device according to claim 9 which further comprises re-lighting means for carrying out re-lighting control when said non-lighted state detecting means detects a non-lighted state.

11. A discharge lamp lighting device comprising a low-intensity, mercury-arc discharge lamp, a high frequency power source supplying high frequency power to said discharge lamp, dimmer control means for dimming said discharge lamp from an arc discharge zone to a glow discharge zone, and DC power supplying means for supplying DC power of a level capable of maintaining a discharge upon low light flux dimming to said discharge lamp, said DC power being superposed on said high frequency power supplied to said lamp from said high frequency power source, the relative illumination of said discharge lamp with respect to illumination at rated current being below 20% upon low light flux dimming, said DC power supplying means including means for regulating said supply of said DC power in accordance with a dimming level.

12. The device according to claim 11 wherein the relative illumination of said discharge lamp with respect to illumination at rated current is 5% upon low light flux dimming, and said DC power supplying means includes means for regulating said supply of said DC power in accordance with a

13. The device according to claim 12 wherein said DC power supply means includes means for stopping superposing of DC power when the relative illumination ratio of said lamp with respect to illumination at rated current is above a predetermined level.

14. The device according to claim 13 wherein said DC power supplying means includes means for regulating said supply of said DC power in accordance with a dimming level.

15. The device according to claim 13 wherein said superposing stopping means comprises a plurality of switching circuits which are connected mutually in parallel with respect to said discharge lamp, and said relative illumination ratio above said predetermined level is different for each of said switching circuits.

16. The device according to claim 13 wherein said superposing stopping means includes a DC power controlling switching means for substantially stopping said DC power superposing when said relative illumination ratio exceeds a predetermined level.

17. The device according to claim 16 which further comprises overcurrent preventing switching means connected in parallel to said DC power controlling switching means for conducting upon starting of said discharge lamp.

18. The device according to claim 17 wherein said DC power controlling switching means and said overcurrent preventing switching means are formed by a common switching means.

19. The device according to claim 12 which further comprises means for substantially stopping said superposing of said DC power in response to a signal for turning off said discharge lamp.

20. The device according to claim 12 which further comprises abnormality detecting means for detecting an abnormal state of said discharge lamp by detecting DC power supplied to said discharge lamp from said DC power supplying means.

21. The device according to claim 20 which further comprises means for stopping said supply of high frequency power to said discharge lamp from said high frequency power source when said abnormality detecting means detects an abnormal state.

22. The device according to claim 12 which further comprises means for detecting a non-lighted state of said discharge lamp by detecting the level of DC power supplied to the discharge lamp from said DC power supplying means.

23. The device according to claim 22 which further comprises re-lighting means for carrying out re-lighting control when said non-lighted state detecting means detects a non-lighted state.

24. A device according to claim 1 wherein to dim the lamp and obtain low light flux the high frequency power is controlled to cause lamp current to be reduced, and wherein a DC power component of lamp current, at levels of low light flux, is maintained at a value sufficient to produce glow discharge.

* * * * *

UNITED STATES PATENT AND TRADEMARK OFFICE

CERTIFICATE OF CORRECTION

PATENT NO. : 5,170,099

DATED : December 8, 1992

INVENTOR(S) : Ueoka et al.

It is certified that error appears in the above-identified patent and that said Letters Patent is hereby corrected as shown below:

Claim 7, col. 30, line 48, change "wherein" to --which--.

Claim 12, col. 31, line 21, after "a" insert --dimming level--.

Signed and Sealed this

Twenty-sixth Day of October, 1993

*Attest:*

*Attesting Officer*

Bruce Lehman

BRUCE LEHMAN

*Commissioner of Patents and Trademarks*